US011298939B2

(12) United States Patent
Yamada et al.

(10) Patent No.: US 11,298,939 B2
(45) Date of Patent: Apr. 12, 2022

(54) LIQUID EJECTING APPARATUS, DRIVE CIRCUIT, AND INTEGRATED CIRCUIT

(71) Applicant: Seiko Epson Corporation, Tokyo (JP)

(72) Inventors: Tomokazu Yamada, Shiojiri (JP); Atsushi Obinata, Shiojiri (JP)

(73) Assignee: Seiko Epson Corporation

( * ) Notice: Subject to any disclaimer, the term of this patent is extended or adjusted under 35 U.S.C. 154(b) by 1 day.

(21) Appl. No.: 16/913,008

(22) Filed: Jun. 26, 2020

(65) Prior Publication Data

US 2020/0406612 A1 Dec. 31, 2020

(30) Foreign Application Priority Data

Jun. 28, 2019 (JP) ..... JP2019-121530

(51) Int. Cl.
*B41J 2/045* (2006.01)

(52) U.S. Cl.
CPC ..... *B41J 2/04541* (2013.01); *B41J 2/0458* (2013.01); *B41J 2/04581* (2013.01)

(58) Field of Classification Search
CPC . B41J 2/04581; B41J 2/04541; B41J 2/04508
See application file for complete search history.

(56) References Cited

U.S. PATENT DOCUMENTS

2006/0267160 A1* 11/2006 Kimura ..... G02F 1/136286 257/664
2018/0272700 A1* 9/2018 Ito ..... B41J 2/04581

FOREIGN PATENT DOCUMENTS

JP 2018-099866 A 6/2018

* cited by examiner

*Primary Examiner* — Lam S Nguyen
(74) *Attorney, Agent, or Firm* — Harness, Dickey & Pierce, P.L.C.

(57) ABSTRACT

A liquid ejecting apparatus includes a drive signal output circuit, a control signal output circuit, a differential signal output circuit, and a head unit, in which the head unit includes an integrated circuit that receives a first drive signal and outputs a second drive signal, and an ejector that ejects liquid from nozzle, and the integrated circuit includes a drive signal input terminal that inputs a first drive signal, a first signal input terminal that inputs a first signal, a second signal input terminal that inputs a second signal, a differential signal receiving circuit that receives the first signal and the second signal, and outputs the control signal, a drive signal selection circuit that outputs the second drive signal based on the control signal and the first drive signal, and a drive signal output terminal that outputs the second drive signal to the ejector.

6 Claims, 16 Drawing Sheets

FIG. 8

| SI (b1, b2, b3) | Ts1 | | | Ts2 | | |
|---|---|---|---|---|---|---|
| | Sa | Sb | Sc | Sa | Sb | Sc |
| (1, 1, 0) | H | L | L | H | L | L |
| (1, 0, 0) | H | L | L | L | H | L |
| (0, 1, 0) | L | H | L | H | L | L |
| (0, 0, 0) | L | H | L | L | H | L |
| (0, 0, 1) | L | L | H | L | L | H |

LIQUID EJECTING APPARATUS, DRIVE CIRCUIT, AND INTEGRATED CIRCUIT

The present application is based on, and claims priority from JP Application Serial Number 2019-121530, filed Jun. 28, 2019, the disclosure of which is hereby incorporated by reference herein in its entirety.

BACKGROUND

1. Technical Field

The present disclosure relates to a liquid ejecting apparatus, a drive circuit, and an integrated circuit.

2. Related Art

As an ink jet printer (liquid ejecting apparatus) that prints an image or a document by ejecting ink as a liquid, an apparatus using a piezoelectric element such as a piezo element is known. In such an ink jet printer, the piezoelectric element is provided for each of a plurality of nozzles in a print head. When a drive signal is supplied to the piezoelectric elements at a predetermined timing, each piezoelectric element is driven, a predetermined amount of ink is ejected from nozzles, and an image or a document is formed on a print medium.

In order to meet the demand for further improvement in printing accuracy in recent years, the number of nozzles of an ink jet printer has been increasing. Then, as the number of nozzles increases, the amount of data transferred to the print head increases. Therefore, as a technique for transferring the data to the print head at a high speed, a technique for transferring the data to the print head by a communication method using a differential signal such as low voltage differential signaling (LVDS) has been known.

For example, Japanese Patent Application Laid-Open No. 2018-099866 discloses a liquid ejecting apparatus that converts various data for ejecting liquid into an LVDS differential signal, transfers the data to a head unit, restores the LVDS differential signal in a control signal receiver provided in the head unit, and controls various operations in the head unit based on the restored signal.

However, in the liquid ejecting apparatus described in JP-A-2018-099866, it is necessary to restore an LVDS differential signal to a single-ended signal on a substrate included in a head unit. For this reason, the scale of the circuit provided in the head unit may increase, and there is room for improvement in terms of miniaturization of the circuit scale.

SUMMARY

According to an aspect of the present disclosure, there is provided a liquid ejecting apparatus including:

a drive signal output circuit that outputs a first drive signal;

a control signal output circuit that outputs an original control signal;

a differential signal output circuit that is electrically coupled to the control signal output circuit, converts the original control signal into a pair of differential signals, and outputs the pair of differential signals;

a drive signal wiring that is electrically coupled to the drive signal output circuit and through which the first drive signal propagates;

a first signal wiring that is electrically coupled to the differential signal output circuit and through which a first signal of one of the pair of differential signals propagates;

a second signal wiring that is electrically coupled to the differential signal output circuit and through which a second signal of the other of the pair of differential signals propagates;

a head unit that is electrically coupled to the drive signal wiring, the first signal wiring, and the second signal wiring, and ejects a liquid, in which the head unit includes an integrated circuit that receives the first drive signal and outputs a second drive signal, and an ejector that is electrically coupled to the integrated circuit, includes a drive element driven based on the second drive signal, and ejects a liquid from nozzles by driving the drive element, and the integrated circuit includes a drive signal input terminal that is electrically coupled to the drive signal wiring and inputs the first drive signal, a first signal input terminal that is electrically coupled to the first signal wiring and inputs the first signal, a second signal input terminal that is electrically coupled to the second signal wiring and inputs the second signal, a differential signal receiving circuit that is electrically coupled to the first signal input terminal and the second signal input terminal, receives the first signal and the second signal, converts the pair of differential signals into a control signal, and outputs the control signal, a drive signal selection circuit that is electrically coupled to the drive signal input terminal and the differential signal receiving circuit and outputs the second drive signal based on the control signal and the first drive signal, and a drive signal output terminal that is electrically coupled to the drive signal selection circuit and outputs the second drive signal to the ejector.

In the liquid ejecting apparatus, the integrated circuit may include a first wiring that is electrically coupled to the first signal input terminal and the differential signal receiving circuit, a second wiring that is electrically coupled to the second signal input terminal and the differential signal receiving circuit, and a resistance element that is electrically coupled to the first wiring and the second wiring.

In the liquid ejecting apparatus, the head unit may include a plurality of the integrated circuits, and a resistance value of a resistance element of a first integrated circuit of the plurality of integrated circuits may be different from a resistance value of a resistance element of a second integrated circuit of the plurality of integrated circuits.

In the liquid ejecting apparatus, the integrated circuit may have a first side and a second side intersecting the first side, the first side may be longer than the second side, and the differential signal receiving circuit and the drive signal selection circuit may be arranged side by side in a direction along the first side.

In the liquid ejecting apparatus, the head unit may have a plurality of the ejectors, the nozzles of each of the ejectors are arranged side by side along a nozzle row direction, and the differential signal receiving circuit and the drive signal selection circuit may be arranged side by side along the nozzle row direction.

In the liquid ejecting apparatus, the number of the nozzles of each of the ejectors in the head unit may be 600 or more, and the nozzles may be arranged at a density of 300 or more per inch.

According to still another aspect of the present disclosure, there is provided a drive circuit including:

a drive signal output circuit that outputs a first drive signal;

a control signal output circuit that outputs an original control signal;

a differential signal output circuit that is electrically coupled to the control signal output circuit, converts the original control signal into a pair of differential signals, and outputs the pair of differential signals;

a drive signal wiring that is electrically coupled to the drive signal output circuit and through which the first drive signal propagates;

a first signal wiring that is electrically coupled to the differential signal output circuit and through which a first signal of one of the pair of differential signals propagates;

a second signal wiring that is electrically coupled to the differential signal output circuit and through which a second signal of the other of the pair of differential signals propagates; and an integrated circuit that is electrically coupled to the drive signal wiring, the first signal wiring, and the second signal wiring, receives the first drive signal, and outputs a second drive signal, in which the integrated circuit includes a drive signal input terminal that is electrically coupled to the drive signal wiring and inputs the first drive signal, a first signal input terminal that is electrically coupled to the first signal wiring and inputs the first signal, a second signal input terminal that is electrically coupled to the second signal wiring and inputs the second signal, a differential signal receiving circuit that is electrically coupled to the first signal input terminal and the second signal input terminal, receives the first signal and the second signal, converts the pair of differential signals into a control signal, and outputs the control signal, a drive signal selection circuit that is electrically coupled to the drive signal input terminal and the differential signal receiving circuit and outputs the second drive signal based on the control signal and the first drive signal, and a drive signal output terminal that is electrically coupled to the drive signal selection circuit and outputs the second drive signal.

According to still another aspect of the present disclosure, there is provided an integrated circuit including:

a drive signal input terminal that inputs a first drive signal;

a first signal input terminal that inputs a first signal of one of a pair of differential signals;

a second signal input terminal that inputs a second signal of the other of the pair of differential signals;

a differential signal receiving circuit that is electrically coupled to the first signal input terminal and the second signal input terminal, receives the first signal and the second signal, converts the pair of differential signals into a control signal, and outputs the control signal;

a drive signal selection circuit that is electrically coupled to the drive signal input terminal and the differential signal receiving circuit and outputs a second drive signal based on the control signal and the first drive signal; and a drive signal output terminal that is electrically coupled to the drive signal selection circuit and outputs the second drive signal.

BRIEF DESCRIPTION OF THE DRAWINGS

FIG. 8 is a view illustrating the content of decoding performed by a decoder.

DESCRIPTION OF EXEMPLARY EMBODIMENTS

Hereinafter, preferred embodiments of the present disclosure will be described with reference to drawings. The drawings to be used are for convenience of description. The embodiments described below do not unduly limit the contents of the present disclosure described in the claims. In addition, all of the configurations described below are not necessarily essential components of the disclosure.

1. Configuration of Liquid Ejecting Apparatus

Figure 1:
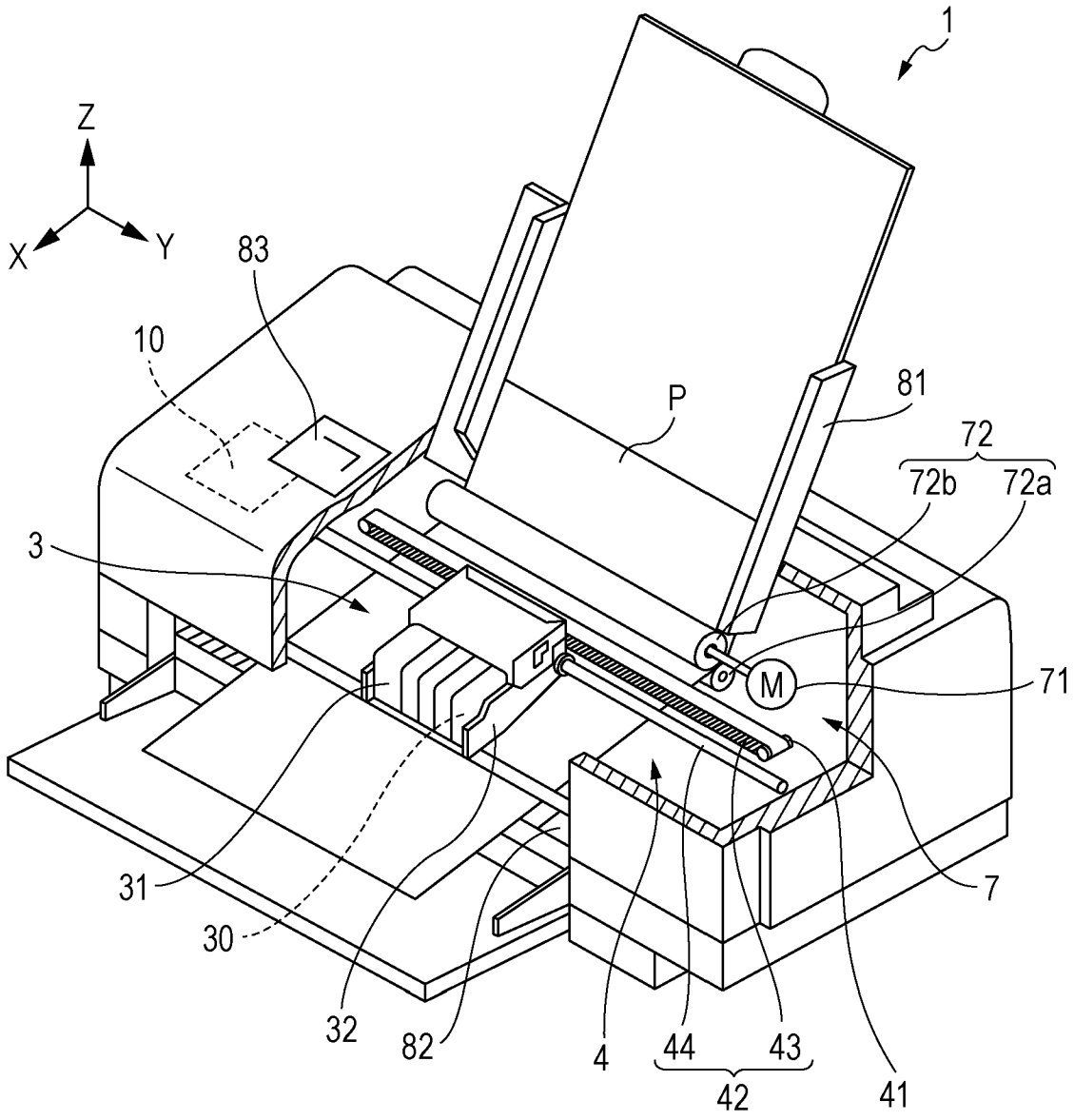
FIG. 1 is a view schematically illustrating a configuration of a liquid ejecting apparatus.

First, a configuration of a liquid ejecting apparatus 1 will be described. FIG. 1 is a view schematically illustrating a configuration of the liquid ejecting apparatus 1 the present embodiment. FIG. 1 illustrates an X direction, a Y direction, and a Z direction that are orthogonal to each other. In the following description, the upper side corresponding to the +Z direction in FIG. 1 may be referred to as "upper", and the lower side corresponding to the −Z direction may be referred to as "lower".

The liquid ejecting apparatus 1 is provided with a tray 81 for installing a medium P at the upper rear, a paper outlet 82 for discharging the medium P at the lower front, and an operation panel 83 on the upper surface. The operation panel 83 includes, for example, a liquid crystal display, an organic EL display, an LED lamp, and the like, and includes an unillustrated display portion that displays an error message and the like, and an unillustrated operator that includes various switches and the like.

In addition, the liquid ejecting apparatus 1 includes a printing portion 4 having a reciprocating moving object 3. The moving object 3 includes a head unit 30 including a plurality of print heads 35 described later, a plurality of ink cartridges 31, and a carriage 32 on which the head unit 30 and the plurality of ink cartridges 31 are mounted. The inside of each print head 35 is filled with ink as an example of the liquid supplied from the ink cartridge 31. Then, each print head 35 ejects the ink filled therein. Each ink cartridge 31 is filled with ink corresponding to an ink color such as yellow, cyan, magenta, and black. The ink cartridge 31 supplies ink to the corresponding print head 35. Then, the print head 35 ejects the supplied color ink.

The liquid ejecting apparatus 1 according to the present embodiment includes a plurality of ink cartridges 31 corresponding to a plurality of ink colors, but may include ink cartridges 31 of overlapping colors. Further, instead of being mounted on the carriage 32, each of the ink cartridges 31 may be provided at another location of the liquid ejecting apparatus 1.

The printing portion 4 includes a carriage motor 41 serving as a drive source for moving the moving object 3 forward and backward along the Y direction which is the main scanning direction, and a reciprocating mechanism 42 for moving the moving object 3 forward and backward by the rotating operation of the carriage motor 41. The reciprocating mechanism 42 has a carriage guide shaft 44 whose both ends are supported by a frame (not illustrated), and a timing belt 43 extending in parallel with the carriage guide shaft 44. The carriage 32 is movably supported forward and backward by the carriage guide shaft 44 and is fixed to a part of the timing belt 43. The moving object 3 is guided by the carriage guide shaft 44 and reciprocates by causing the timing belt 43 to travel forward and backward through the pulleys by the operation of the carriage motor 41.

In addition, the liquid ejecting apparatus 1 includes a paper feeding device 7 for supplying and discharging the medium P to and from the printing portion 4. The paper feeding device 7 includes a paper feeding motor 71 serving as a drive source, and a paper feeding roller 72 that is rotated by the operation of the paper feeding motor 71. The paper feeding roller 72 includes a driven roller 72*a* facing up and down with the medium P interposed in the transport path of the medium P and a drive roller 72*b*. Here, the drive roller 72*b* is connected to the paper feeding motor 71. Thus, the paper feeding roller 72 feeds a plurality of media P set on the tray 81 one by one toward the printing portion 4 and discharges one by one from the printing portion 4. The liquid ejecting apparatus 1 may have a configuration in which a paper feeding cassette that accommodates the medium P may be detachably mounted instead of the tray 81.

Further, the liquid ejecting apparatus 1 includes a controller 10 that controls the printing portion 4 and the paper feeding device 7. The controller 10 performs printing processing on the medium P by controlling the printing portion 4 and the paper feeding device 7 based on image data input from a host computer such as a personal computer or a digital camera.

Specifically, the controller 10 controls the paper feeding device 7 to intermittently feed the media P one by one in the sub-scanning direction, which is the X direction. The controller 10 controls the moving object 3 to reciprocate in the main scanning direction, which is the Y direction intersecting the sub-scanning direction. That is, the controller 10 controls the moving object 3 to reciprocate in the main scanning direction and controls the paper feeding device 7 to intermittently feed the medium P in the sub-scanning direction. Then, the controller 10 executes printing processing on the medium P by controlling the ejection timing of the ink from each print head 35 based on the input image data.

Further, the controller 10 displays an error message or the like on the display portion of the operation panel 83 or turns on/off an LED lamp or the like, and causes each portion to execute the corresponding processing based on various switch pressing signals input from the operator of the operation panel 83. Further, the controller 10 executes processing of transferring information such as an error message and an ejection abnormality to the host computer as necessary.

Figure 2:
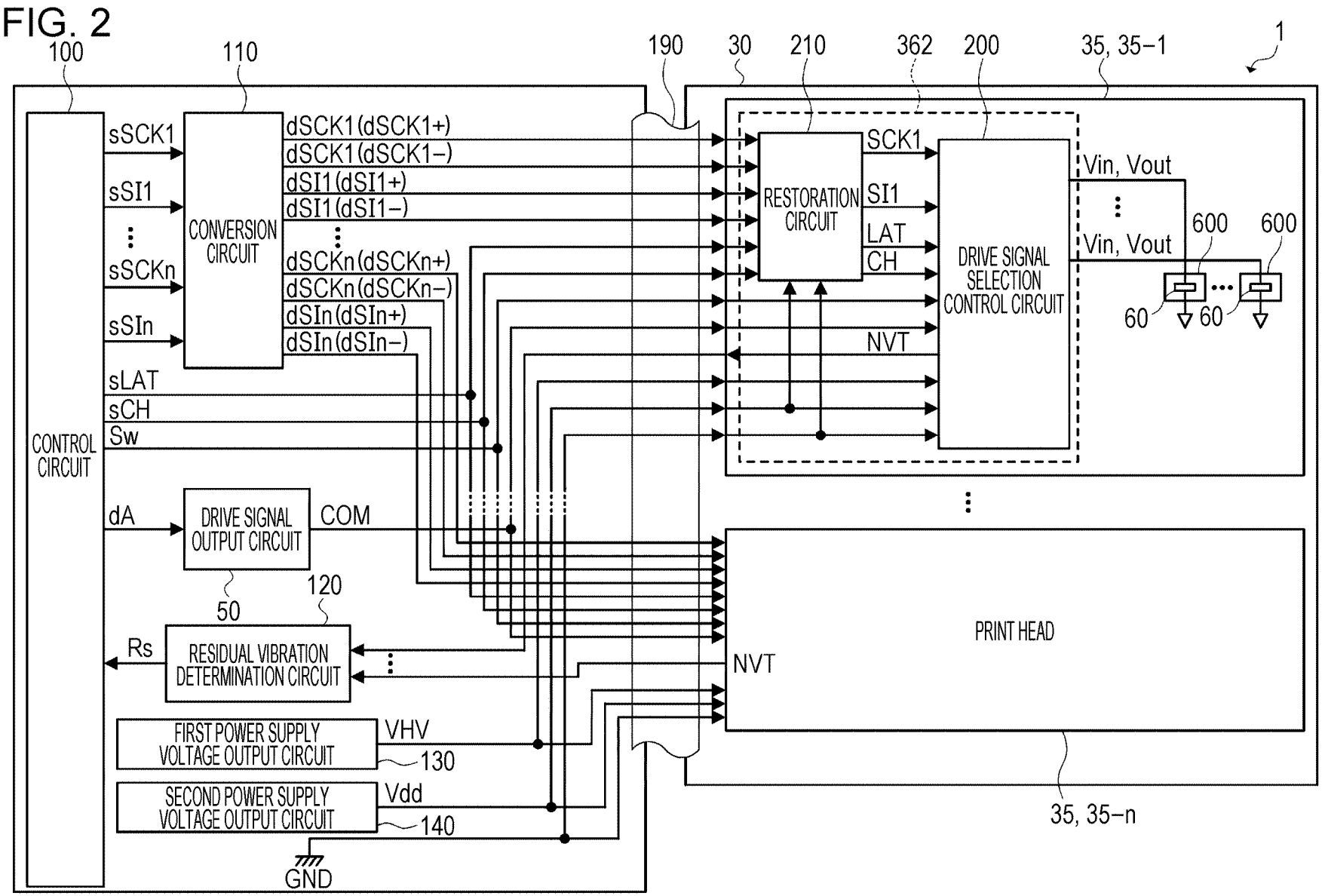
FIG. 2 is a view illustrating an electrical configuration of the liquid ejecting apparatus.

FIG. 2 is a view illustrating an electrical configuration of the liquid ejecting apparatus 1 according to the present embodiment. As illustrated in FIG. 2, the liquid ejecting apparatus 1 includes the controller 10 and the head unit 30. The controller 10 includes a control circuit 100, a conversion circuit 110, a drive signal output circuit 50, a residual vibration determination circuit 120, a first power supply voltage output circuit 130, and a second power supply voltage output circuit 140.

The control circuit 100 includes, for example, a processor such as a microcontroller. The control circuit 100 generates and outputs data and various signals for controlling the liquid ejecting apparatus 1 based on various signals such as image data input from the host computer. Specifically, the control circuit 100 generates and outputs base clock signals sSCK1 to sSCKn, base print data signals sSl1 to sSln, a base latch signal sLAT, a base change signal sCH, a switching control signal Sw, and a base drive signal dA for controlling the liquid ejecting apparatus 1.

The base clock signals sSCK1 to sSCKn and the base print data signals sSl1 to sSln are input to the conversion circuit 110, respectively. The conversion circuit 110 converts each of the input base clock signals sSCK1 to sSCKn and the base print data signals sSl1 to sSln into a pair of differential signals. Specifically, the conversion circuit 110 converts each of the base clock signals sSCK1 to sSCKn into a pair of differential clock signals dSCK1 to dSCKn. The conversion circuit 110 converts each of the base print data signals sSl1 to sSln into a pair of differential print data signals dSI1 to dSln. Then, the conversion circuit 110 outputs the differential clock signals dSCK1 to dSCKn and the differential print data signals dSI1 to dSln to the print head 35, respectively.

In the following description, one of the pair of differential clock signals dSCK1 to dSCKn may be referred to as differential clock signal dSCK1+ to dSCKn+, respectively, and the other one of the pair of differential clock signals dSCK1 to dSCKn may be referred to as differential clock signals dSCK1− to dSCKn−, respectively. Similarly, one of the pair of differential print data signals dSI1 to dSIn may be referred to as differential print data signal dSI1+ to dSIn+, respectively, and the other of the pair of differential print data signals dSI1 to dSIn may be referred to as differential print data signals dSI1− to dSIn−, respectively.

Here, the base clock signal sSCK1 is an example of an original control signal, and the pair of differential clock signals dSCK1 obtained by converting the base clock signal sSCK1 is an example of a pair of differential signals. One differential clock signal dSCK1+ of the pair of differential clock signals dSCK1 is an example of a first signal, and the other differential clock signal dSCK1− of the pair of differential clock signals dSCK1 is an example of a second signal. The base print data signal sSI1 is another example of the original control signal, and the pair of differential print data signals dSI1 obtained by converting the base print data signal sSI1 is another example of the pair of differential signals. One differential print data signal dSI1+ of the pair of differential print data signals dSI1 is another example of a first signal, and the other differential print data signal dSI1− of the pair of differential print data signals dSI1 is another example of a second signal.

Then, the control circuit 100 that outputs the base clock signal sSCK1 and the base print data signal sSI1 is an example of a control signal output circuit, and the conversion circuit 110 that is electrically coupled to the control circuit 100, converts the base clock signal sSCK1 into a pair of differential clock signals dSCK1, converts the base print data signal sSI1 into a pair of differential print data signals dSI1, and outputs the pair of differential print data signals dSI1 is is an example of a differential signal output circuit.

Each of the base latch signal sLAT, the base change signal sCH, and the switching control signal Sw is input to the head unit 30.

The base drive signal dA is a digital signal, and is a signal based on a drive signal COM for driving a piezoelectric element 60 as an example of the drive element included in the print head 35 included in the head unit 30. The base drive signal dA is input to the corresponding drive signal output circuit 50.

The drive signal output circuit 50 converts the input base drive signal dA into a digital/analog signal, and generates and outputs a drive signal COM by class-D amplifying the converted analog signal. The base drive signal dA may be any signal as long as the signal can define the waveform of the drive signal COM, and may be an analog signal. Further, the class-D amplifier circuit included in the drive signal output circuit 50 only needs to be able to amplify a waveform defined by the base drive signal dA, and may be configured by a class-A amplifier circuit, a class-B amplifier circuit, a class-AB amplifier circuit, or the like. Here, although the details will be described later, in the present embodiment, the drive signal output circuit 50 generates three drive signals Com-A, Com-B, and Com-C as the drive signal COM and outputs the same to the head unit 30. Here, the drive signal COM is an example of a first drive signal. Therefore, each of the three drive signals Com-A, Com-B, and Com-C as the drive signal COM is also an example of the first drive signal.

In the present embodiment, the drive signal output circuit 50 outputs a common drive signal COM to the plurality of print heads 35 described later, but the drive signal output circuit 50 may generate and output a drive signal COM having a different waveform corresponding to each of the plurality of print heads 35. That is, the drive signal output circuit 50 includes a plurality of class-D amplifier circuits that generate drive signals COM having different waveforms, and the control circuit 100 may output a plurality of base drive signals dA corresponding to each of the plurality of class-D amplifier circuits.

The first power supply voltage output circuit 130 generates a voltage VHV and outputs the same to the head unit 30. Further, the second power supply voltage output circuit 140 generates a voltage VDD and outputs the same to the head unit 30. The voltage VHV and the voltage VDD are used for various power supply voltages in the head unit 30. The voltage VHV and the voltage VDD may be used for various power supply voltages in the controller 10 and the like.

Further, a determination result signal Rs is input to the control circuit 100 from the residual vibration determination circuit 120. Further, a residual vibration signal NVT is input from the head unit 30 to the residual vibration determination circuit 120. The residual vibration determination circuit 120 determines the presence or absence of an ejection abnormality in the head unit 30 based on the input residual vibration signal NVT and outputs the determination result signal Rs indicating the determination result to the control circuit 100. The control circuit 100 causes a maintenance mechanism (not illustrated) to execute recovery processing for the ejection abnormality based on the determination result signal Rs. The details of the residual vibration signal NVT will be described later.

Although not described in FIG. 2, the control circuit 100 may generate a control signal for controlling various components of the liquid ejecting apparatus 1 and output the generated control signal to a corresponding component.

The head unit 30 is driven based on various control signals input from the controller 10 to eject ink. The head unit 30 has n print heads 35. Each of the n print heads 35 receives a corresponding differential clock signal dSCKj (j is any of 1 to n) among the differential clock signals dSCK1 to dSCKn, a corresponding differential print data signal dSIj among the differential print data signals dSI1 to dSIn, the base latch signal sLAT, the base change signal sCH, the switching control signal Sw, the drive signal COM, the voltages VHV and VDD, and a ground signal GND. The plurality of print heads 35 have the same configuration. Therefore, in the following description, the print head 35 to which the differential clock signal dSCK1 and the differential print data signal dSI1 are input will be described, and the description of the other print heads 35 will be omitted.

The print head 35 includes an integrated circuit 362 and a plurality of ejectors 600. Further, the integrated circuit 362 includes a drive signal selection control circuit 200 and a restoration circuit 210.

The restoration circuit 210 receives the differential clock signal dSCK1, the differential print data signal dSI1, the base latch signal sLAT, and the base change signal sCH. Then, the restoration circuit 210 restores the differential clock signal dSCK1 and the differential print data signal dSI1 into a single-ended signal based on the various signals input. Specifically, the restoration circuit 210 restores the differential clock signal dSCK1 and the differential print data signal dSI1 into a single-ended signal based on the timing defined by the input base latch signal sLAT and the base change signal sCH.

The base latch signal sLAT and the base change signal sCH input to the restoration circuit 210 are output from the restoration circuit 210 as a latch signal LAT and a change signal CH after defining the timing for restoring a pair of differential signals into a single-ended signal. Here, the base latch signal sLAT and the base change signal sCH input to the restoration circuit 210 and the latch signal LAT and the change signal CH output from the restoration circuit 210 may be signals having the same waveform when the delay occurring in the restoration circuit 210 is not taken into account.

As described above, by inputting a differential signal that is a signal to be restored and a single-ended signal for controlling the liquid ejecting apparatus 1 to the restoration circuit 210, a similar delay occurs between the single-ended signal restored by the restoration circuit 210 and the single-ended signal not restored by the restoration circuit 210, based on the operation and configuration of the restoration circuit 210. Therefore, it is possible to reduce a difference in delay time occurring between the single-ended signal restored by the restoration circuit 210 and the single-ended signal not restored by the restoration circuit 210. Accordingly, it is possible to reduce a possibility that a difference in signal delay time occurs between a clock signal SCK1 generated based on the differential signal from the controller 10, and a print data signal SI1, and the latch signal LAT generated based on a signal input as a single-ended signal, and the change signal CH.

Here, the clock signal SCK1 is an example of a control signal, and the print data signal SI is another example of the control signal.

The drive signal selection control circuit 200 receives the voltages VHV and VDD, the clock signal SCK1, the print data signal SI1, the latch signal LAT, the change signal CH, the drive signal COM, and the ground signal GND. Then, the drive signal selection control circuit 200 outputs the drive signal Vin based on the clock signal SCK1, the print data signal SI1, the latch signal LAT, the change signal CH, and the drive signal COM.

Specifically, the drive signal selection control circuit 200 generates and outputs the drive signal Vin by selecting or deselecting the waveform of the drive signal COM based on the clock signal SCK1, the print data signal SI1, the latch signal LAT, and the change signal CH. The drive signal Vin output from the drive signal selection control circuit 200 is supplied to one end of the piezoelectric element 60 included in each of the plurality of ejectors 600. Then, when the piezoelectric element 60 is driven based on the drive signal Vin, ink is ejected from the corresponding ejector 600.

Further, a residual vibration Vout generated after the piezoelectric element 60 is driven is input to the drive signal selection control circuit 200. The drive signal selection control circuit 200 generates a residual vibration signal NVT based on the cycle of the input residual vibration Vout and outputs the same to the residual vibration determination circuit 120.

As described above, the integrated circuit 362 included in the print head 35 converts the drive signal COM into the drive signal Vin and outputs the same. The ejector 600 includes the piezoelectric element 60 that is electrically coupled to the integrated circuit 362 and is driven based on the drive signal Vin, and ejects ink from nozzles N described later by driving the piezoelectric element 60. Further, the piezoelectric element 60 is an example of a drive element, and the drive signal Vin supplied to the piezoelectric element 60 is an example of a second drive signal.

The controller 10 and the head unit 30 are electrically coupled by a cable 190. The cable 190 includes a flexible flat cable (FFC). The controller 10 and the head unit 30 are electrically coupled by a plurality of wirings included in the cable 190. Then, the signal generated by the controller 10 propagates through each wiring included in the cable 190 and is input to the head unit 30, and the signal generated by the head unit 30 propagates through each wiring included in the cable 190 and is input to the controller 10.

Specifically, the cable 190 includes a wiring that is electrically coupled to the drive signal output circuit 50 and through which the drive signal COM propagates, a wiring that is electrically coupled to the conversion circuit 110 and through which one differential clock signal dSCK1+ of the pair of differential clock signals dSCK1 propagates, a wiring that is electrically coupled to the conversion circuit 110 and through which the other differential clock signal dSCK1− of the pair of differential clock signals dSCK1 propagates, a wiring that is electrically coupled to the conversion circuit 110 and through which one differential print data signal dSI1+ of the pair of differential print data signals dSI1 propagates, a wiring that is electrically coupled to the conversion circuit 110 and through which the other differential print data signal dSI1− of the pair of differential print data signals dSI1 propagates, a wiring that is electrically coupled to the residual vibration determination circuit 120 and through which the residual vibration signal NVT propagates, a wiring that is electrically coupled to the first power supply voltage output circuit 130 and through which the voltage VHV propagates, a wiring that is electrically coupled to the second power supply voltage output circuit 140 and through which voltage VDD propagates, and a plurality of wirings through which the ground signal GND propagates. As described above, when the cable 190 is electrically coupled to the head unit 30, various control signals are supplied to the head unit 30 and the plurality of print heads 35 of the print head 35 by the plurality of wirings of the cable 190.

Here, the wiring through which the drive signal COM propagates is an example of a drive signal wiring, the wiring through which the differential clock signal dSCK1+ propagates is an example of a first signal wiring, the wiring through which the differential clock signal dSCK1− propagates is an example of a second signal wiring, the wiring through which the differential print data signal dSI1+ propagates is another example of the first signal wiring, and the wiring through which the differential print data signal dSI1 propagates is another example of the second signal wiring.

A configuration including the control circuit 100, the conversion circuit 110, the drive signal output circuit 50, and the integrated circuit 362 is an example of a drive circuit.

2. Configuration of Print Head

Figure 3:
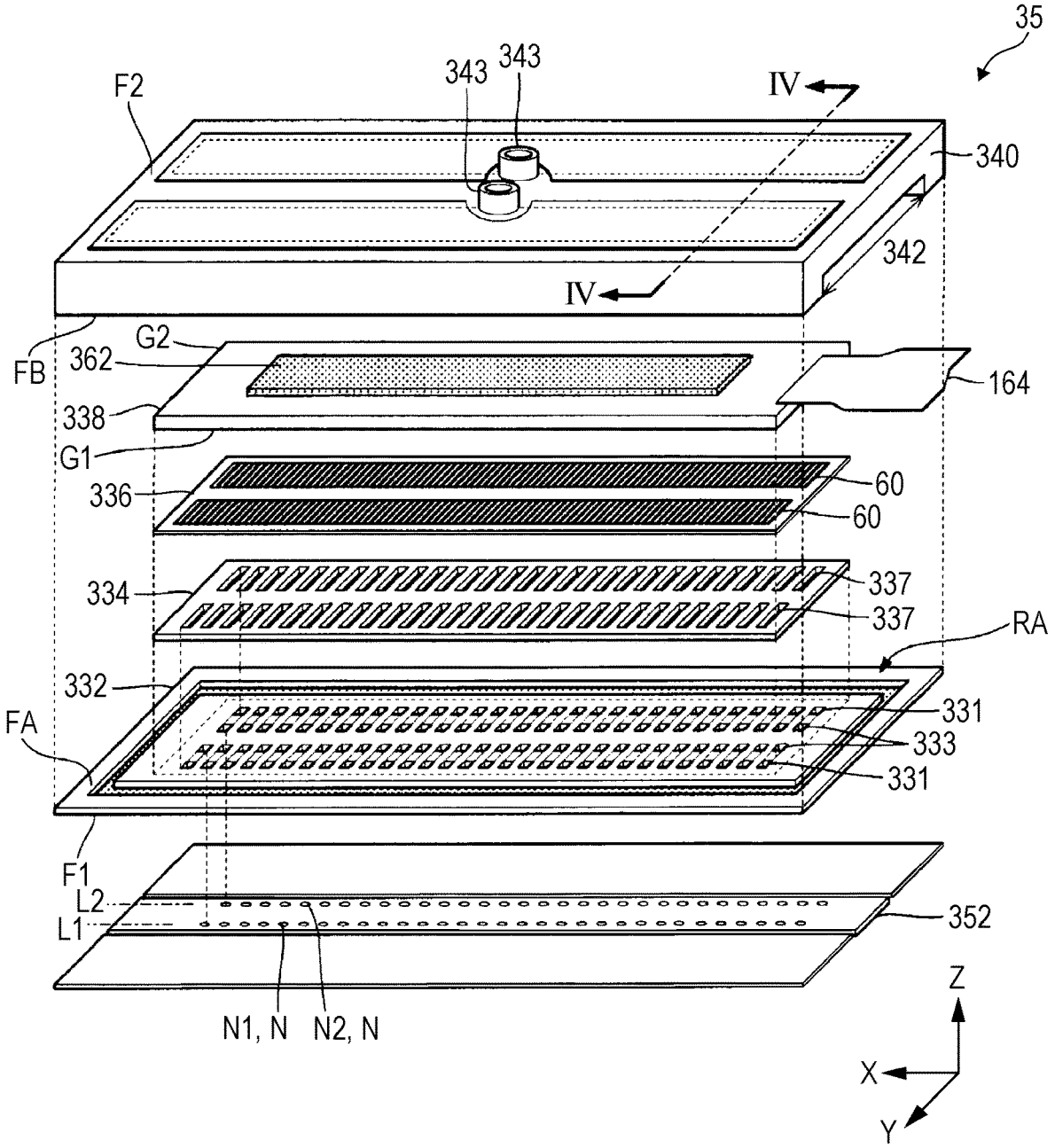
FIG. 3 is an exploded perspective view of a print head.
Figure 4:
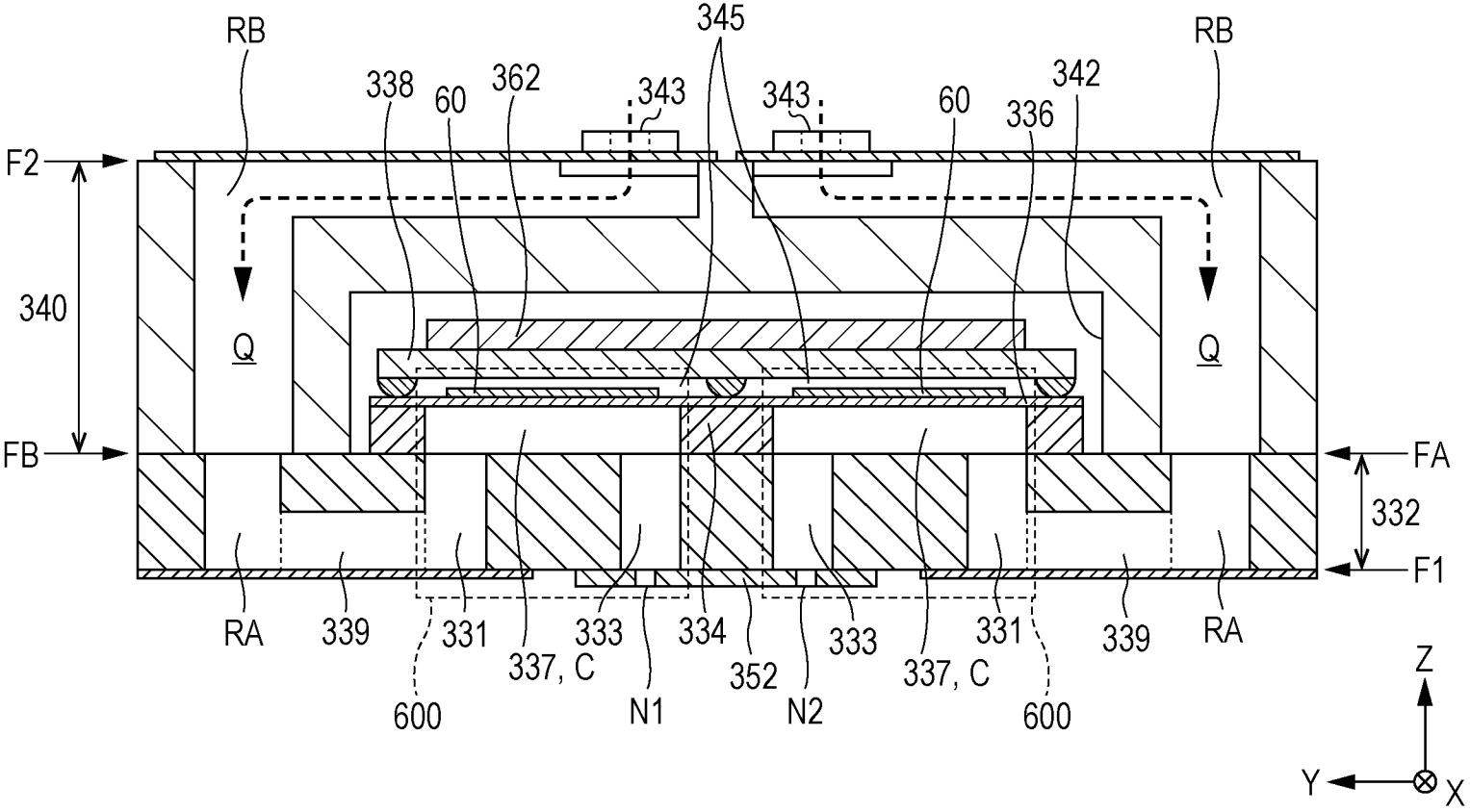
FIG. 4 is a sectional view illustrating a section of the print head taken along the line IV-IV in FIG. 3.

Next, the configuration of the print head 35 included in the head unit 30 will be described. FIG. 3 is an exploded perspective view of the print head 35. FIG. 4 is a sectional view illustrating a section of the print head 35 taken along the line IV-IV in FIG. 3.

As illustrated in FIG. 3, the print head 35 includes 2M nozzles N arranged in the X direction. In the present embodiment, the 2M nozzles N are arranged in two rows, row L1 and row L2. In the following description, each of the M nozzles N belonging to the row L1 may be referred to as a nozzle N1, and each of the M nozzles N belonging to the row L2 may be referred to as a nozzle N2. In the following description, it is assumed that the position of the i-th (i is a natural number satisfying $1 \leq i \leq M$) nozzle N1 in the X direction among the M nozzles N1 belonging to the row L1 substantially coincides with the position of the i-th nozzle N2 among the M nozzles N2 belonging to the row L2. Here, the term "substantially coincides" includes not only a case where the positions completely match each other but also a case where positions can be regarded as the same in consideration of an error. The 2M nozzles N may be arranged in a so-called staggered manner in which the i-th nozzle N1 among the M nozzles N1 belonging to the row L1 and the i-th nozzle N2 among the M nozzles N2 belonging to the row L2 have different positions in the X direction.

As illustrated in FIGS. 3 and 4, the print head 35 includes a channel substrate 332. The channel substrate 332 is a plate-shaped member including a surface F1 and a surface FA. The surface F1 is a surface on the medium P side as viewed from the print head 35, and the surface FA is a surface on the opposite side to the surface F1. A pressure chamber substrate 334, an actuator substrate 336, a plurality of piezoelectric elements 60, a wiring substrate 338, and a housing 340 are provided on the surface FA. A nozzle plate 352 is provided on the surface F1. Each element of the print head 35 is a plate-shaped member that is generally long in the X direction and is stacked in the Z direction.

The nozzle plate 352 is a plate-shaped member, and the nozzle plate 352 is formed with the 2M nozzles N as through holes. In the following description, the nozzles N corresponding to each of the rows L1 and L2 are provided at a density of 300 or more per inch on the nozzle plate 352, and a total of 600 or more nozzles N are formed. In other words, in the print head 35, the number of nozzles N included in each of the ejectors 600 is 600 or more, and the nozzles are arranged at a density of 300 or more per inch. A surface of the nozzle plate 352 that is located outside the print head 35 and faces the medium P may be referred to as a nozzle surface.

The channel substrate 332 is a plate-shaped member for forming a channel for ink. As illustrated in FIGS. 3 and 4, a channel RA is formed in the channel substrate 332. In the channel substrate 332, 2M channels 331 and 2M channels 333 are formed so as to correspond to the 2M nozzles N on a one-to-one basis. The channel 331 and the channel 333 are openings formed to penetrate the channel substrate 332 as illustrated in FIG. 4. The channel 333 communicates with the nozzle N corresponding to the channel 333. In addition, two channels 339 are formed on the surface F1 of the channel substrate 332. One of the two channels 339 is a channel that connects the channel RA and the M channels 331 corresponding to the M nozzles N1 belonging to the row L1 on a one-to-one basis, and the other of the two channels 339 is a channel that connects the channel RA and the M channels 331 corresponding to the M nozzles N2 belonging to the row L2 on a one-to-one basis.

As illustrated in FIGS. 3 and 4, the pressure chamber substrate 334 is a plate-shaped member in which 2M openings 337 are formed so as to correspond to the 2M nozzles N on a one-to-one basis. The actuator substrate 336 is provided on the surface of the pressure chamber substrate 334 opposite to the channel substrate 332.

As illustrated in FIG. 4, the actuator substrate 336 and the surface FA of the channel substrate 332 face each other at an interval inside each opening 337. The space located between the surface FA of the channel substrate 332 and the actuator substrate 336 inside the opening 337 functions as a cavity C for applying pressure to the ink filled in the space. The cavity C is, for example, a space having the Y direction as a longitudinal direction and the X direction as a lateral direction. The print head 35 is provided with 2M cavities C so as to correspond to the 2M nozzles N on a one-to-one basis. The cavity C provided corresponding to the nozzle N1 communicates with the channel RA via the channel 331 and the channel 339 and communicates with the nozzle N1 via the channel 333. Further, the cavity C provided corresponding to the nozzle N2 communicates with the channel RA via the channel 331 and the channel 339 and communicates with the nozzle N2 via the channel 333.

As illustrated in FIGS. 3 and 4, on the surface of the actuator substrate 336 opposite to the cavity C, 2M piezoelectric elements 60 are provided so as to correspond to the 2M cavities C on a one-to-one basis. The drive signal Vin is supplied to the piezoelectric element 60. Then, the piezoelectric element 60 is driven according to the supplied drive signal Vin. The actuator substrate 336 vibrates in conjunction with the deformation of the piezoelectric element 60. Then, when the actuator substrate 336 vibrates, the internal pressure of the cavity C fluctuates, and due to the fluctuation of the internal pressure of the cavity C, the ink filled in the cavity C is ejected from the nozzle N via the channel 333.

The configuration including the cavity C, the channels 331 and 333, the nozzle N, the actuator substrate 336, and the piezoelectric element 60 functions as the ejector 600 for ejecting the ink filled in the cavity C by driving the piezoelectric element 60. That is, in the print head 35, the plurality of ejectors 600 corresponding to the plurality of nozzles N along the X direction are arranged side by side in two rows corresponding to the rows L1 and L2. Here, the head unit 30 includes the plurality of ejectors 600, and the nozzles N of each of the plurality of ejectors 600 are arranged side by side along the X direction. The direction in which the nozzles N included in each of the plurality of ejectors 600 are arranged is an example of a direction of nozzle rows, and in the present embodiment, the nozzles N are arranged in the X direction. That is, the X direction is also an example of the direction of nozzle rows.

The wiring substrate 338 illustrated in FIGS. 3 and 4 includes a surface G1 and a surface G2 facing the surface G1. In the wiring substrate 338, the drive signal COM propagates toward the integrated circuit 362 and the drive signal Vin output from the integrated circuit 362 propagates. The wiring substrate 338 is also a plate-shaped member for protecting the 2M piezoelectric elements 60 formed on the actuator substrate 336.

Two accommodation spaces 345 are formed on the surface G1 of the wiring substrate 338, which is the surface on the medium P side as viewed from the print head 35. One of the two accommodation spaces 345 is a space for accommodating the M piezoelectric elements 60 corresponding to the M nozzles N1, and the other is a space for accommodating M piezoelectric elements 60 corresponding to the M nozzles N2. The height, which is the width in the Z direction, of the accommodation space 345 is sufficiently large so that the piezoelectric element 60 does not contact the wiring substrate 338 even if the piezoelectric element 60 is displaced.

The integrated circuit 362 is provided on the surface G2 of the wiring substrate 338 opposite to the surface G1. The restoration circuit 210 and the drive signal selection control circuit 200 are mounted on the integrated circuit 362 as described above. The integrated circuit 362 receives the drive signal COM, the differential clock signal dSCK1, the differential print data signal dSI1, the base latch signal sLAT, the base change signal sCH, and the switching control signal Sw that are input to the print head 35. Then, the integrated circuit 362 generates and outputs the drive signal Vin by selecting or deselecting the drive signal COM based on the input differential clock signal dSCK1, the differential print data signal dSI1, the base latch signal sLAT, and the base change signal sCH. Accordingly, the wiring substrate 338 is provided with a plurality of wirings for propagating the drive signal COM, the differential clock signal dSCK1, the differential print data signal dSI, the base latch signal sLAT, the base change signal sCH, and the switching control signal Sw and a plurality of wirings for supplying the drive signal Vin output from the integrated circuit 362 to the piezoelectric element 60.

Further, one end of the coupling wiring 164 is electrically coupled to the wiring substrate 338. The other end of the coupling wiring 164 is coupled to a wiring substrate (not illustrated) of the print head 35. The plurality of signals input to the print head 35 are input to the print head 35 via the coupling wiring 164 after being propagated through the wiring substrate. That is, the coupling wiring 164 is a member in which a plurality of wirings for transferring various signals to the integrated circuit 362 are formed, and is formed of, for example, a flexible printed circuit (FPC) or a flexible flat cable (FFC).

Figure 5:
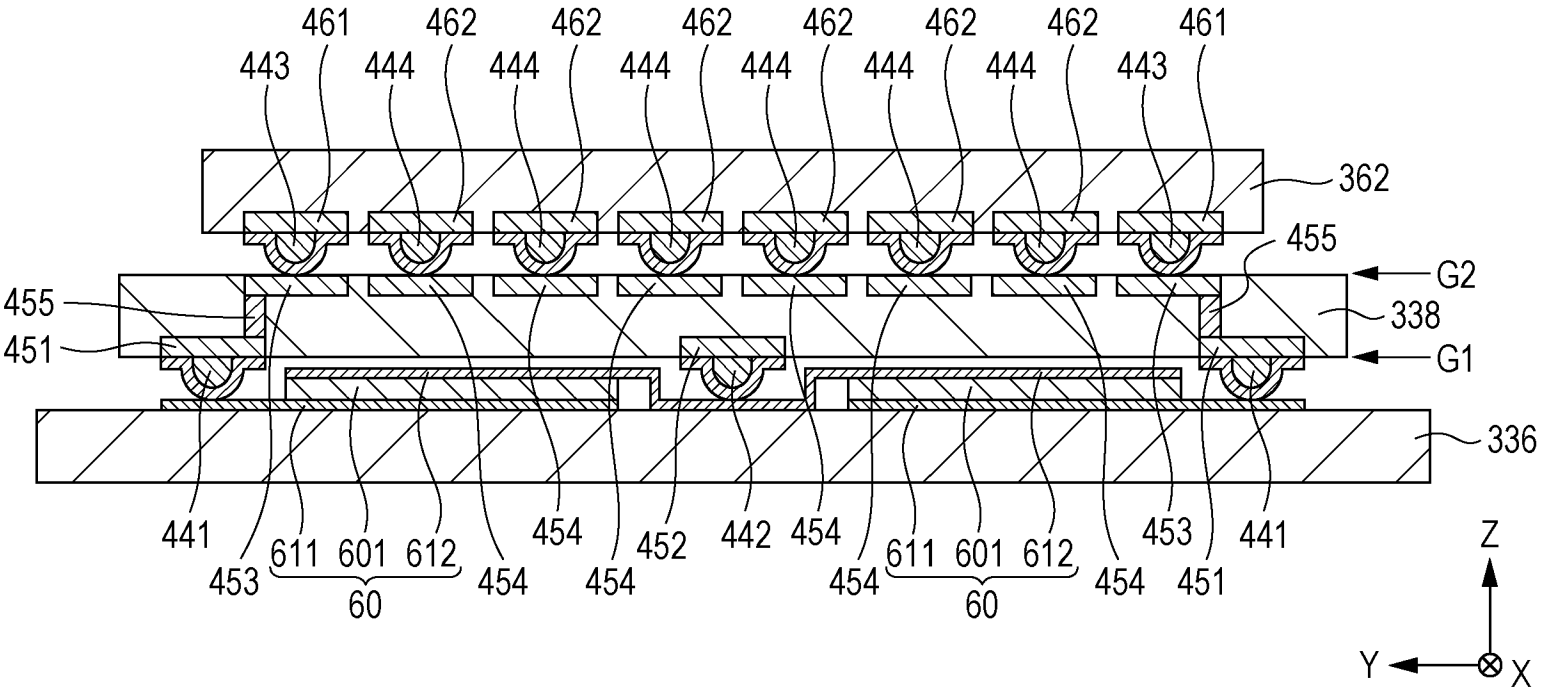
FIG. 5 is a view illustrating electrical coupling of an integrated circuit, a wiring substrate, an actuator substrate, and a piezoelectric element.

Here, the electrical coupling of the integrated circuit 362, the wiring substrate 338, the actuator substrate 336, and the piezoelectric element 60 will be described with reference to FIG. 5. FIG. 5 is a view illustrating electrical coupling of the integrated circuit 362, the wiring substrate 338, the actuator substrate 336, and the piezoelectric element 60.

On the upper surface of the actuator substrate 336 in the Z direction, the plurality of piezoelectric elements 60 are arranged side by side in two rows along the Y direction as illustrated in FIG. 3. In each piezoelectric element 60, a lower electrode layer 611, a piezoelectric layer 601, and an upper electrode layer 612 are sequentially stacked on the upper surface of the actuator substrate 336 along the Z direction. When the drive signal Vin is supplied to the lower electrode layer 611 of the piezoelectric element 60 configured as described above, a potential difference occurs between the lower electrode layer 611 and the upper electrode layer 612. Then, when the piezoelectric layer 601 is displaced according to the potential difference, the actuator substrate 336 is deformed in the Z direction.

Here, the lower electrode layer 611 is an individual electrode for supplying the drive signal Vin to each of the piezoelectric elements 60, and the upper electrode layer 612 is a common electrode for supplying a signal common to the plurality of piezoelectric elements 60, which is a reference voltage having a constant potential. The lower electrode layer 611 may be a common electrode to which a reference voltage is supplied, and the upper electrode layer 612 may be an individual electrode to which the drive signal Vin is supplied.

The wiring substrate 338 having a plurality of wirings and terminals for supplying various signals to the actuator substrate 336 is stacked on the upper surface of the actuator substrate 336 in the Z direction. A plurality of bump electrodes 441 for supplying a drive signal Vin output from the integrated circuit 362 to the corresponding piezoelectric element 60 are provided between the surface G1 of the wiring substrate 338 and the lower electrode layer 611. That is, the plurality of bump electrodes 441 are provided corresponding to the plurality of piezoelectric elements 60 arranged side by side in the two rows. When the bump electrode 441 is electrically coupled to the lower electrode layer 611, the drive signal Vin output from the integrated circuit 362 is supplied to the piezoelectric element 60. Each bump electrode 441 is also electrically coupled to a corresponding terminal 451 formed on the surface G1 of the wiring substrate 338.

Further, a bump electrode 442 for supplying a reference voltage to the upper electrode layer 612 is provided between the surface G1 of the wiring substrate 338 and the upper electrode layer 612. When the bump electrode 442 is electrically coupled to the upper electrode layer 612, the piezoelectric element 60 is supplied with the reference voltage supplied via the wiring substrate 338. The bump electrode 442 is also electrically coupled to a terminal 452 formed on the surface G1 of the wiring substrate 338.

A terminal 453 that is electrically coupled to the terminal 451 via a through wiring 455 is formed on a surface G2 of the wiring substrate 338 opposite to the surface G1. A plurality of terminals 454 are formed on the surface G2 of the wiring substrate 338.

The integrated circuit 362 is mounted on the upper surface of the wiring substrate 338 in the Z direction. A bump electrode 443 is provided on the surface of the integrated circuit 362 facing the wiring substrate 338 in an area facing the terminal 453 of the wiring substrate 338. The bump electrode 443 is electrically coupled to a terminal 461 formed on the integrated circuit 362. Similarly, a bump electrode 444 is provided on the surface of the integrated circuit 362 facing the wiring substrate 338 in an area facing the terminal 454 of the wiring substrate 338. Further, the bump electrode 444 is electrically coupled to a terminal 462 formed on the integrated circuit 362.

In the integrated circuit 362, the wiring substrate 338, the actuator substrate 336, and the piezoelectric element 60 electrically coupled as described above, the drive signal COM, the differential clock signal dSCK1, the differential print data signal dSI1, the base latch signal sLAT, the base change signal sCH, and the switching control signal Sw supplied from the coupling wiring 164 propagate through a wiring (not illustrated) provided on the wiring substrate 338 and are input to the integrated circuit 362 via the terminal 454, the bump electrode 444, and the terminal 462. Each of the differential clock signal dSCK1, the differential print data signal dSI1, the base latch signal sLAT, and the base change signal sCH input to the integrated circuit 362 is converted into a clock signal SCK1, a print data signal SI1, a latch signal LAT, and a change signal CH in the restoration circuit 210 mounted on the integrated circuit 362. The clock signal SCK1, the print data signal SI1, the latch signal LAT, the change signal CH, the switching control signal Sw, and the drive signal COM are input to the drive signal selection control circuit 200 mounted on the integrated circuit 362. Then, the drive signal selection control circuit 200 generates the drive signal Vin by selecting or deselecting the drive signal COM based on the clock signal SCK1, the print data signal SI1, the latch signal LAT, and the change signal CH, and the same is output from the terminal 461.

The drive signal Vin output from the terminal 461 is supplied to the lower electrode layer 611 of the piezoelectric element 60 via the bump electrode 443, the terminal 453, the through wiring 455, the terminal 451, and the bump electrode 441. As a result, a potential difference occurs between the lower electrode layer 611 and the upper electrode layer 612 of the piezoelectric element 60, and the piezoelectric layer 601 is displaced. Then, based on the displacement of the piezoelectric layer 601, the actuator substrate 336 is deformed, and therefore the pressure in the cavity C changes and ink is ejected from the nozzle N.

In addition, after this series of ink ejecting operations is completed, before the next ink ejecting operation is started, damped vibration occurs in the actuator substrate 336. Specifically, damped vibration occurs in the actuator substrate 336 based on a change in the internal pressure of the cavity after the drive signal Vin is supplied to the piezoelectric element 60. When the piezoelectric element 60 is displaced by the damped vibration, a signal based on the damped vibration is input to the integrated circuit 362. Hereinafter, a signal input from the piezoelectric element 60 to the integrated circuit 362 based on the damped vibration is referred to as a residual vibration Vout. In the residual vibration Vout, at least one of the cycle of the damped vibration and the vibration frequency changes due to abnormal viscosity of the ink ejected from the nozzle N, mixing of bubbles into the cavity, and adhesion of paper powder near the nozzle N, and the like.

The integrated circuit 362 in the present embodiment detects the residual vibration Vout, generates the residual vibration signal NVT indicating at least one of the cycle and the vibration frequency of the residual vibration Vout, and outputs the signal to the residual vibration determination circuit 120. Then, the residual vibration determination circuit 120 determines the cycle and the vibration frequency of the residual vibration Vout based on the residual vibration signal NVT, thereby determining whether or not there is an ink ejection abnormality from the nozzle N.

3. Configuration of Integrated Circuit 3.1. Circuit Configuration of Integrated Circuit As described above, the integrated circuit 362 generates the drive signal Vin by selecting or deselecting the drive signal COM based on the differential clock signal dSCK1, the differential print data signal dSI1, the base latch signal sLAT, and the base change signal sCH, generates the residual vibration signal NVT based on the residual vibration Vout and outputs the signal to the residual vibration determination circuit 120, in addition to outputting to the piezoelectric element 60. Here, the configuration and operation of the integrated circuit 362 are described. In the following description, among the drive signals Vin output from the drive signal selection control circuit 200, the drive signal Vin supplied to the piezoelectric elements 60 corresponding to the M nozzles N1 included in the row L1 illustrated in FIG. 3 is referred to as a drive signal Vin1, the residual vibration Vout generated by the piezoelectric element 60 is referred to as a residual vibration Vout1, and a signal indicating the cycle and the vibration frequency of the residual vibration Vout1 may be referred to as a residual vibration signal NVT1. Similarly, the drive signal Vin supplied to the piezoelectric elements 60 corresponding to the M nozzles N2 included in the row L2 is referred to as a drive signal Vin2, the residual vibration Vout generated by the piezoelectric elements 60 is referred to as a residual vibration Vout2, and a signal indicating the vibration frequency of the residual vibration Vout2 may be referred to as a residual vibration signal NVT2.

Figure 6:
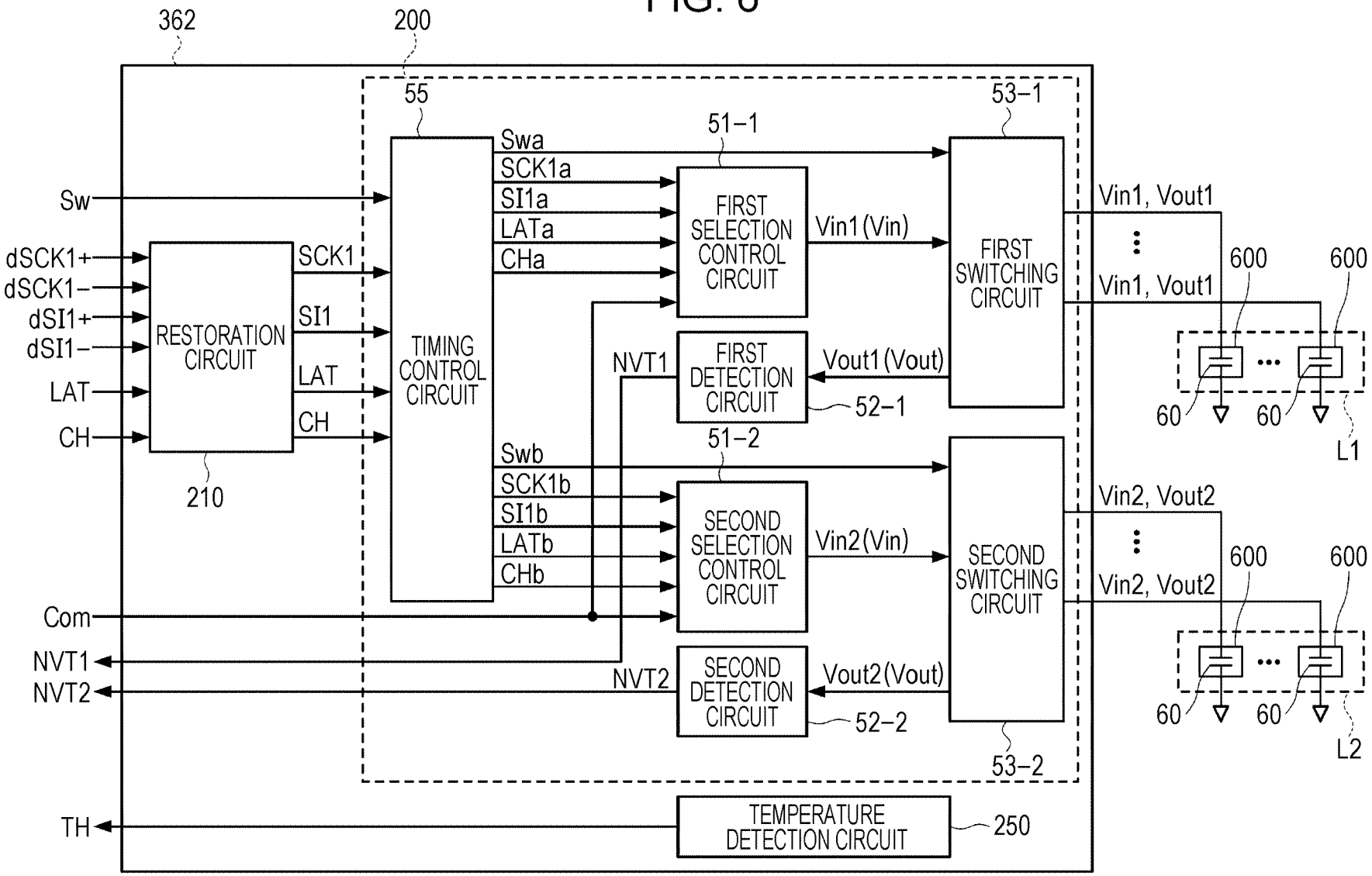
FIG. 6 is a view illustrating an electrical configuration of the integrated circuit.

FIG. 6 is a view illustrating an electrical configuration of the integrated circuit 362. As illustrated in FIG. 6, the integrated circuit 362 includes the restoration circuit 210, the drive signal selection control circuit 200, and a temperature detection circuit 250.

The restoration circuit 210 receives the differential clock signal dSCK1, the differential print data signal dSI1, the base latch signal sLAT, and the base change signal sCH. Then, as described above, the restoration circuit 210 generates the clock signal SCK1, the print data signal SI1, the latch signal LAT, and the change signal CH based on the differential clock signal dSCK1, the differential print data signal dSI1, the base latch signal sLAT, and the base change signal sCH. Then, the clock signal SCK1, the print data signal SI1, the latch signal LAT, and the change signal CH generated by the restoration circuit 210 are input to the drive signal selection control circuit 200.

Specifically, the restoration circuit 210 receives the differential clock signal dSCK1+ and the differential clock signal dSCK1− included in the pair of differential clock signals dSCK1, converts the pair of differential clock signals dSCK1 to the clock signal SCK1, and outputs the same. Further, the restoration circuit 210 receives the differential print data signal dSI1+ and the differential print data signal dSI1− included in the pair of differential print data signals dSI1, converts the pair of differential print data signals dSI1 into the print data signal SI1, and outputs the same. The restoration circuit 210 is an example of a differential signal receiving circuit.

The drive signal selection control circuit 200 includes a first selection control circuit 51-1, a second selection control circuit 51-2, a first detection circuit 52-1, a second detection circuit 52-2, a first switching circuit 53-1, a second switching circuit 53-2 and a timing control circuit 55.

The timing control circuit 55 receives the clock signal SCK1, the print data signal SI1, the latch signal LAT, the change signal CH, and the switching control signal Sw. The timing control circuit 55 branches the clock signal SCK1, the print data signal SI1, the latch signal LAT, and the change signal CH into a clock signal SCK1*a*, a print data signal SI1*a*, a latch signal LATa, and a change signal CHa corresponding to the first selection control circuit 51-1, and a clock signal SCK1*b*, a print data signal SI1*b*, a latch signal LATb, and a change signal CHb corresponding to the second selection control circuit 51-2 and outputs the same to each of the corresponding first selection control circuit 51-1 and second selection control circuit 51-2.

The timing control circuit 55 branches the input switching control signal Sw into a switching control signal Swa corresponding to the first switching circuit 53-1 and a switching control signal Swb corresponding to the second switching circuit 53-2 and outputs the same to each of the corresponding first switching circuit 53-1 and second switching circuit 53-2.

Here, the timing control circuit 55 may be configured as a gate array circuit in the integrated circuit 362. Further, the integrated circuit 362 may not include the timing control circuit 55, the restoration circuit 210 may generate the clock signal SCK1*a*, the print data signal SIla, the latch signal LATa, and the change signal CHa corresponding to the first selection control circuit 51-1, and the clock signal SCK1*b*, the print data signal SI1*b*, the latch signal LATb, and the change signal CHb corresponding to the second selection control circuit 51-2 based on the differential clock signal dSCK1, the differential print data signal dSI1, the base latch signal sLAT, and the base change signal sCH, and the control circuit 100 may generate the switching control signal Swa corresponding to the first switching circuit 53-1 and the switching control signal Swb corresponding to the second switching circuit 53-2.

The clock signal SCK1*a*, the print data signal SIla, the latch signal LATa, the change signal CHa, and the drive signal COM output from the drive signal output circuit 50 are input to the first selection control circuit 51-1. Then, the first selection control circuit 51-1 outputs the drive signal Vin1 based on the clock signal SCK1*a*, the print data signal SI1*a*, the latch signal LATa, the change signal CHa, and the drive signal COM. Specifically, the first selection control circuit 51-1 generates and outputs the drive signal Vin1 supplied to the piezoelectric element 60 corresponding to the nozzle N1 included in the row L1 by selecting or deselecting the drive signal COM based on the clock signal SCK1*a*, the print data signal SI1*a*, the latch signal LATa, and the change signal CHa.

The first switching circuit 53-1 switches between supplying the drive signal Vin1 to the piezoelectric element 60 corresponding to the nozzle N1 based on the switching control signal Swa and supplying the residual vibration Vout1 generated in the piezoelectric element 60 to the first detection circuit 52-1 after the drive signal Vin1 is supplied to the piezoelectric element 60 corresponding to the nozzle N1. In other words, the first switching circuit 53-1 switches between electrically coupling the piezoelectric element 60 corresponding to the nozzle N1 and the first selection control circuit 51-1 and electrically coupling the piezoelectric element 60 and the first detection circuit 52-1.

The first detection circuit 52-1 detects the input residual vibration Vout1. Then, the first detection circuit 52-1 generates and outputs the residual vibration signal NVT1 based on the detected residual vibration Vout1. In other words, the first detection circuit 52-1 outputs the residual vibration signal NVT1 based on the residual vibration Vout1 generated by driving the piezoelectric element 60.

The clock signal SCK1*b*, the print data signal SI1*b*, the latch signal LATb, the change signal CHb, and the drive signal COM output from the drive signal output circuit 50 are input to the second selection control circuit 51-2. Then, the second selection control circuit 51-2 outputs the drive signal Vin2 based on the clock signal SCK1*b*, the print data signal SI1*b*, the latch signal LATb, the change signal CHb, and the drive signal COM. Specifically, the second selection control circuit 51-2 generates the drive signal Vin2 and outputs the same to the second switching circuit 53-2 by selecting or deselecting the drive signal COM based on the clock signal SCK1*b*, the print data signal SI1*b*, the latch signal LATb, and the change signal CHb.

The second switching circuit 53-2 switches between supplying the drive signal Vin2 to the piezoelectric element 60 corresponding to the nozzle N2 based on the switching control signal Swb and supplying the residual vibration Vout2 generated in the piezoelectric element 60 after the drive signal Vin2 is supplied to the piezoelectric element 60 corresponding to the nozzle N2 to the second detection circuit 52-2. In other words, the second switching circuit 53-2 switches between electrically coupling the piezoelectric element 60 corresponding to the nozzle N2 and the second selection control circuit 51-2 and electrically coupling the piezoelectric element 60 and the second detection circuit 52-2.

The second detection circuit 52-2 detects the input residual vibration Vout2. Then, the second detection circuit 52-2 generates and outputs the residual vibration signal NVT2 based on the detected residual vibration Vout2. In other words, the second detection circuit 52-2 outputs the residual vibration signal NVT2 based on the residual vibration Vout2 generated by driving the piezoelectric element 60.

That is, the drive signal selection control circuit 200 mounted on the integrated circuit 362 generates and outputs the drive signal Vin1 for driving the piezoelectric element 60 corresponding to the nozzle N1 included in the row L1 and the drive signal Vin2 for driving the piezoelectric element 60 corresponding to the nozzle N2 included in the row L2, inputs the residual vibration Vout1 generated in the piezoelectric element 60 corresponding to the nozzle N1 included in the row L1 and the residual vibration Vout2 generated in the piezoelectric element 60 corresponding to the nozzle N2 included in the row L2, and generates and outputs the residual vibration signal NVT1 based on the residual vibration Vout1 and the residual vibration signal NVT2 based on the residual vibration Vout2.

Here, the first selection control circuit 51-1 is an example of a drive signal selection circuit, and the second selection control circuit 51-2 is another example of the drive signal selection circuit.

Each of the first selection control circuit 51-1, the first detection circuit 52-1, and the first switching circuit 53-1, and each of the second selection control circuit 51-2, the second detection circuit 52-2, and the second switching circuit 53-2 have the same configuration, except that the input signal and the output signal are different. Therefore, in the following description, the first selection control circuit 51-1 and the second selection control circuit 51-2 may be referred to as a selection control circuit 51 when there is no need to distinguish therebetween, the first and second detection circuits 52-1 and 52-2 may be referred to as a detection circuit 52 when there is no need to distinguish therebetween, and the first switching circuit 53-1 and the second switching circuit 53-2 may be referred to as a switching circuit 53 when there is no need to distinguish therebetween.

Then, the description will be given on the assumption that the selection control circuit 51 receives the clock signal SCK1, the print data signal SI1, the latch signal LAT, the change signal CH, and the drive signal COM, the selection control circuit 51 generates the drive signal Vin based on various input signals, the switching circuit 53 switches between supplying the drive signal Vin to the piezoelectric element 60 and supplying the residual vibration Vout generated in the piezoelectric element 60 to the detection circuit 52, and the detection circuit 52 generates and outputs the residual vibration signal NVT based on the residual vibration Vout.

The temperature detection circuit 250 detects the temperatures of the drive signal selection control circuit 200 and the integrated circuit 362 and generates and outputs temperature information TH corresponding to the detected temperatures. The temperature detection circuit 250 may output a voltage value corresponding to the detected temperature as the temperature information TH or output a signal indicating whether the detected temperatures exceed a predetermined threshold as the temperature information TH. The temperature detection circuit 250 may detect the temperatures of the drive signal selection control circuit 200 and the integrated circuit 362 and output both a voltage value corresponding to the detected temperatures and a signal indicating whether the detected temperatures exceed a predetermined threshold as the temperature information TH.

When a power supply voltage is supplied to the integrated circuit 362 in addition to the restoration circuit 210, the drive signal selection control circuit 200, and the temperature detection circuit 250, the integrated circuit 362 includes a circuit having a lower switching frequency than the vibration frequency of the residual vibration Vout during the printing processing of the liquid ejecting apparatus 1, such as a power-on reset circuit (not illustrated) for resetting the inside of the integrated circuit 362, a test circuit (not illustrated) for inspecting the operation of the integrated circuit 362, and the like. In other words, the integrated circuit 362 is a low-frequency circuit having a lower switching frequency than that of the detection circuit 52, and includes a temperature detection circuit that detects a temperature of the integrated circuit 362, a power-on reset circuit that sets the integrated circuit 362 to a predetermined state when the power of the integrated circuit 362 is turned on, and a test circuit that executes operation test of the integrated circuit 362.

Specifically, when the temperature exceeds a predetermined threshold, the temperature detection circuit 250 controls a switching element such as a transistor included therein to be turned on or off. Thereby, the logic level of the temperature information TH output from the temperature detection circuit 250 is switched. That is, the switching element included in the temperature detection circuit 250 continues to be turned on or off when the integrated circuit 362 has no abnormal temperature or when the integrated circuit 362 has abnormal temperature. Therefore, during the printing processing of the liquid ejecting apparatus 1, the switching frequency of the switching element included in the temperature detection circuit 250 is lower than the vibration frequency of the residual vibration Vout. That is, the temperature detection circuit 250 is one of the circuits whose switching frequency is lower than the vibration frequency of the residual vibration Vout during the printing processing of the liquid ejecting apparatus 1.

In addition, when a power supply voltage is supplied to the integrated circuit 362, or when the power supply voltage supplied to the integrated circuit 362 is lower than a predetermined threshold, the power-on reset circuit controls a switching element such as a transistor included therein to be turned on or off. As a result, the logic level of the signal output from the power-on reset circuit changes. Then, when the signal is input to the integrated circuit 362, an internal register or the like is reset to a predetermined value according to the logic level of the signal. That is, the switching element included in the power-on reset circuit continues to be turned on or off when the voltage value of the power supply voltage supplied to the integrated circuit 362 is stable, for example, during the printing processing of the liquid ejecting apparatus 1. Therefore, during the printing processing of the liquid ejecting apparatus 1, the switching frequency of the switching element included in the power-on reset circuit is lower than the vibration frequency of the residual vibration Vout. That is, the power-on reset circuit is one of the circuits having a lower switching frequency than that of the vibration frequency of the residual vibration Vout during the printing processing of the liquid ejecting apparatus 1.

The test circuit is a circuit for inspecting the operation of the integrated circuit 362 in non-printing processing such as the manufacturing stage of the liquid ejecting apparatus 1 and the integrated circuit 362, and does not operate during the printing processing of the liquid ejecting apparatus 1. Therefore, the switching frequency of the switching element such as the transistor included in the test circuit during the printing processing of the liquid ejecting apparatus 1 is lower than the vibration frequency of the residual vibration Vout. That is, the test circuit is one of the circuits having a lower switching frequency than the vibration frequency of the residual vibration Vout during the printing processing of the liquid ejecting apparatus 1.

Here, the circuit having a lower switching frequency than the vibration frequency of the residual vibration Vout is not limited to the example of the circuit described above. For example, in the case of a circuit configuration that does not include a switching element, since the switching operation is not performed, the circuit is one of circuits having a lower switching frequency than the vibration frequency of the residual vibration Vout.

3.2 Configuration and Operation of Selection Control Circuit

Figure 7:
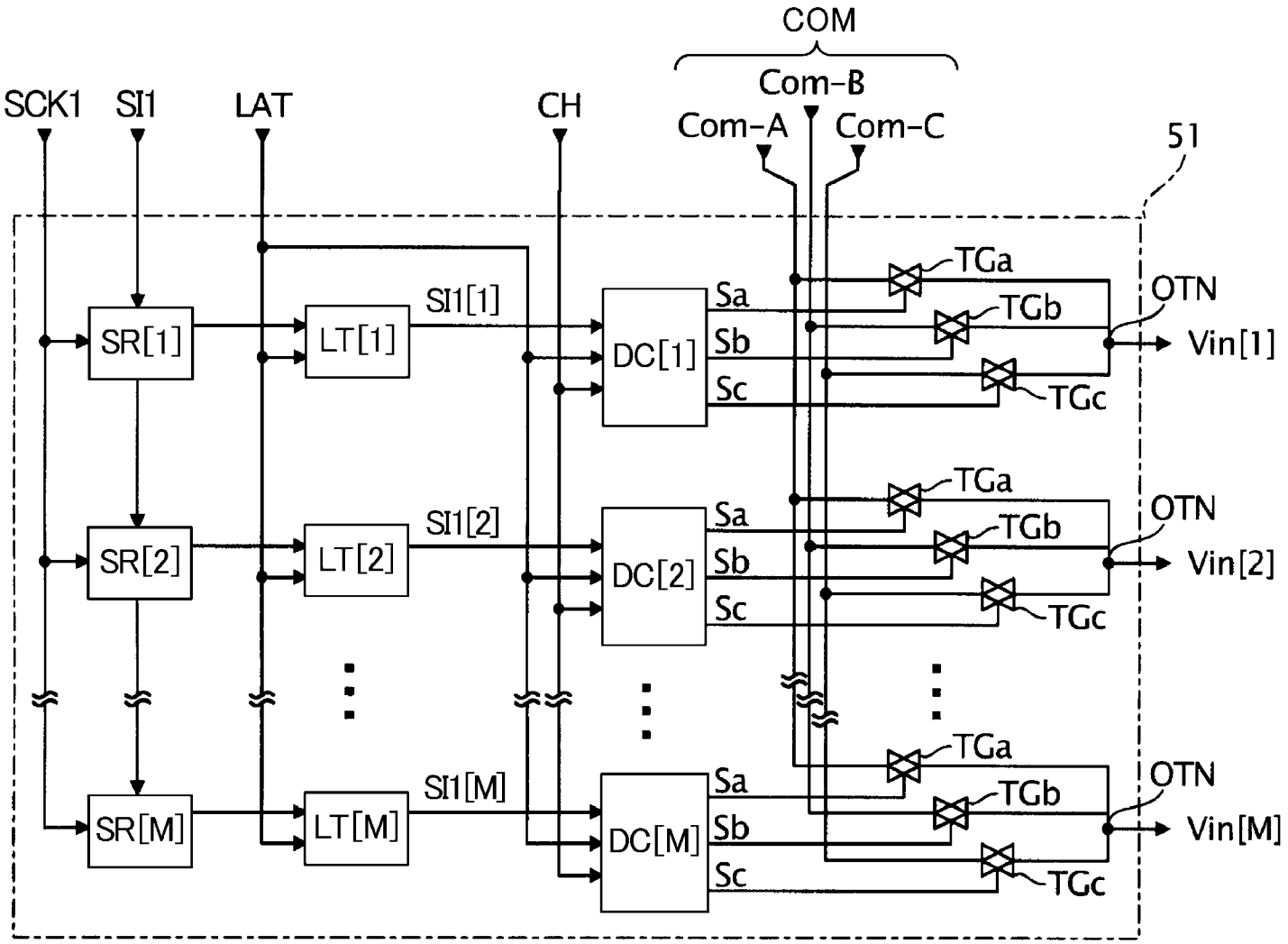
FIG. 7 is a block view illustrating a configuration of a selection control circuit.

Next, the configuration and operation of the selection control circuit 51 will be described with reference to FIGS. 7 to 10. FIG. 7 is a block view illustrating a configuration of the selection control circuit 51. As illustrated in FIG. 7, the selection control circuit 51 includes M sets of a shift register SR, a latch circuit LT, a decoder DC, and transmission gates TGa, TGb, and TGc so as to correspond to the M nozzles N on a one-to-one basis. In the following description, each element of the M sets may be referred to as stage 1, stage 2, . . . , stage M. In FIG. 7, the shift registers SR corresponding to stage 1, stage 2, . . . , stage M are denoted by SR[1], SR[2], . . . , SR[M], and the latch circuit LT is denoted by LT[1], LT[2], . . . , LT[M], the decoder DC is denoted by DC[1], DC[2], . . . , DC[M], and the drive signal Vin is denoted by Vin[1], Vin[2], . . . , Vin[M].

The selection control circuit 51 is supplied with the clock signal SCK1, the print data signal SI1, the latch signal LAT, the change signal CH, and the drive signal COM. Here, although the details will be described later, as illustrated in FIG. 7, the drive signal COM in the present embodiment includes three drive signals Com-A, Com-B, and Com-C.

The print data signal SI1 is a digital signal that defines the amount of ink ejected from the corresponding nozzle N when one dot of an image is formed. More specifically, the print data signal SI1 includes 3-bit print data [b1, b2, b3], and defines the amount of ink to be ejected from the nozzle N by the print data [b1, b2, b3]. The print data signal SI1 is input as a serial signal from the timing control circuit 55 in synchronization with the clock signal SCK1. The selection control circuit 51 generates the drive signal Vin corresponding to the amount of ink to be ejected from the nozzles N based on the input print data signal SI1. By supplying the drive signal Vin corresponding to the amount of the ejected ink to the corresponding piezoelectric element 60, on the medium P, dots expressing four gradations of non-printing, a small dot, a medium dot, and a large dot are formed. Further, the selection control circuit 51 also generates a drive signal Vin for inspection for inspecting the state of the nozzle N based on the input print data signal SI1.

Each of the shift registers SR temporarily holds the print data signal SI1 for each 3-bit information corresponding to each of the nozzles N and sequentially transfers the print data signal SI1 to the shift register SR in a subsequent stage in accordance with the clock signal SCK1. Specifically, M shift registers SR corresponding to each of the M nozzles N in a one-to-one basis are coupled in cascade. The print data signal SI1 supplied in serial is sequentially transferred to the shift register SR in the subsequent stage in accordance with the clock signal SCK1. Then, when the print data signal SI1 is transferred to all of the M shift registers SR, the supply of the clock signal SCK1 is stopped. As a result, the print data signal SI1 corresponding to each of the M nozzles N is held in each of the M shift registers SR.

Each of the M latch circuits LT simultaneously latches 3-bit print data [b1, b2, b3] held by each of the M shift registers SR in synchronization with the rise of the latch signal LAT. Here, SI1[1] to SI1[M] illustrated in FIG. 7 are held in each of the M shift registers SR[1] to SR[M], and M print data [b1, b2, b3] latched by the corresponding latch circuits LT[1] to LT[M] are illustrated.

By the way, the operation period in which the liquid ejecting apparatus 1 executes printing includes a plurality of unit operation periods Tu. Further, each unit operation period Tu includes a control period Ts1 and a control period Ts2 subsequent thereto. The plurality of unit operation periods Tu include the unit operation period Tu in which printing processing is executed, the unit operation period Tu in which ejection abnormality detection processing is executed, and the unit operation period Tu in which both the printing processing and the ejection abnormality detection processing are executed, and the like.

The timing control circuit 55 supplies the selection control circuit 51 with the print data signal SI1 for each unit operation period Tu and controls the selection control circuit 51 so that the latch circuit LT latches the print data signal SI1 for each unit operation period Tu. That is, the timing control circuit 55 controls the selection control circuit 51 so that the drive signal Vin is supplied to the piezoelectric elements 60 corresponding to the M nozzles N for each unit operation period Tu.

Specifically, when the print head 35 executes only the printing processing in the unit operation period Tu, the timing control circuit 55 controls the selection control circuit 51 so that the drive signal Vin for printing is supplied to the piezoelectric elements 60 corresponding to the M nozzles N. In this case, an amount of ink corresponding to the image data input to the liquid ejecting apparatus 1 is ejected from each of the M nozzles N onto the medium P. Therefore, an image corresponding to the image data is formed on the medium P.

On the other hand, when the print head 35 executes only the ejection abnormality detection processing in the unit operation period Tu, the timing control circuit 55 controls the selection control circuit 51 so that the drive signal Vin for inspection is supplied to the piezoelectric elements 60 corresponding to the M nozzles N.

In addition, when the print head 35 executes both the printing processing and the ejection abnormality detection processing in the unit operation period Tu, the timing control circuit 55 controls the selection control circuit 51 so that the drive signal Vin for printing is supplied to a part of the piezoelectric elements 60 corresponding to the M nozzles N and controls the selection control circuit 51 so that the drive signal Vin for inspection is supplied to the piezoelectric elements 60 corresponding to the remaining nozzles N.

The decoder DC decodes the 3-bit print data [b1, b2, b3] latched by the latch circuit LT and outputs H level or L level selection signals Sa, Sb, Sc in each of the control periods Ts1 and Ts2.

FIG. 8 is a view illustrating the content of decoding performed by a decoder DC. As illustrated in FIG. 8, when the print data [b1, b2, b3] is [1, 0, 0], the corresponding decoder DC sets the selection signal Sa to the H level, the selection signals Sb and Sc to the L level in the control period Ts1 and sets the selection signals Sa and Sc to the L level, and the selection signal Sb to the H level in the control period Ts2.

Returning to FIG. 7, the selection control circuit 51 includes M sets of transmission gates TGa, TGb, and TGc. These M sets of transmission gates TGa, TGb, and TGc are provided so as to correspond to the M nozzles N on a one-to-one basis.

The transmission gate TGa is turned on when selection signal Sa is at H level and turned off when selection signal Sa is at L level. That is, the transmission gate TGa is conductive when the selection signal Sa is at the H level and not conductive when the selection signal Sa is at the L level. Similarly, the transmission gate TGb is turned on when selection signal Sb is at H level and turned off when selection signal Sb is at L level. The transmission gate TGc is turned on when the selection signal Sc is at H level, and turned off when the selection signal Sc is at L level.

For example, when the print data [b1, b2, b3] is [1, 0, 0], the transmission gate TGa is controlled to be on and the transmission gates TGb and TGc are controlled to be off in the control period Ts1. In the control period Ts2, the transmission gate TGb is controlled to be on, and the transmission gates TGa and TGc are controlled to be off.

As illustrated in FIG. 7, a drive signal Com-A of the drive signal COM is supplied to one end of the transmission gate TGa, and a drive signal Com-B of the drive signal COM is supplied to one end of the transmission gate TGb, a drive signal Com-C of the drive signal COM is supplied to one end of the transmission gate TGc. The other ends of the transmission gates TGa, TGb, and TGc are commonly coupled to an output end of the OTN to the switching circuit 53.

Here, as illustrated in FIG. 8, the selection signals Sa, Sb, and Sc are exclusively at the H level. Therefore, transmission gates TGa, TGb, and TGc are exclusively turned on in each of control periods Ts1 and Ts2. Then, the drive signals Com-A, Com-B, and Com-C exclusively selected for each of the control periods Ts1 and Ts2 are output to the output terminal OTN as the drive signal Vin and are supplied to the corresponding piezoelectric elements 60 via the switching circuit 53.

Figure 9:
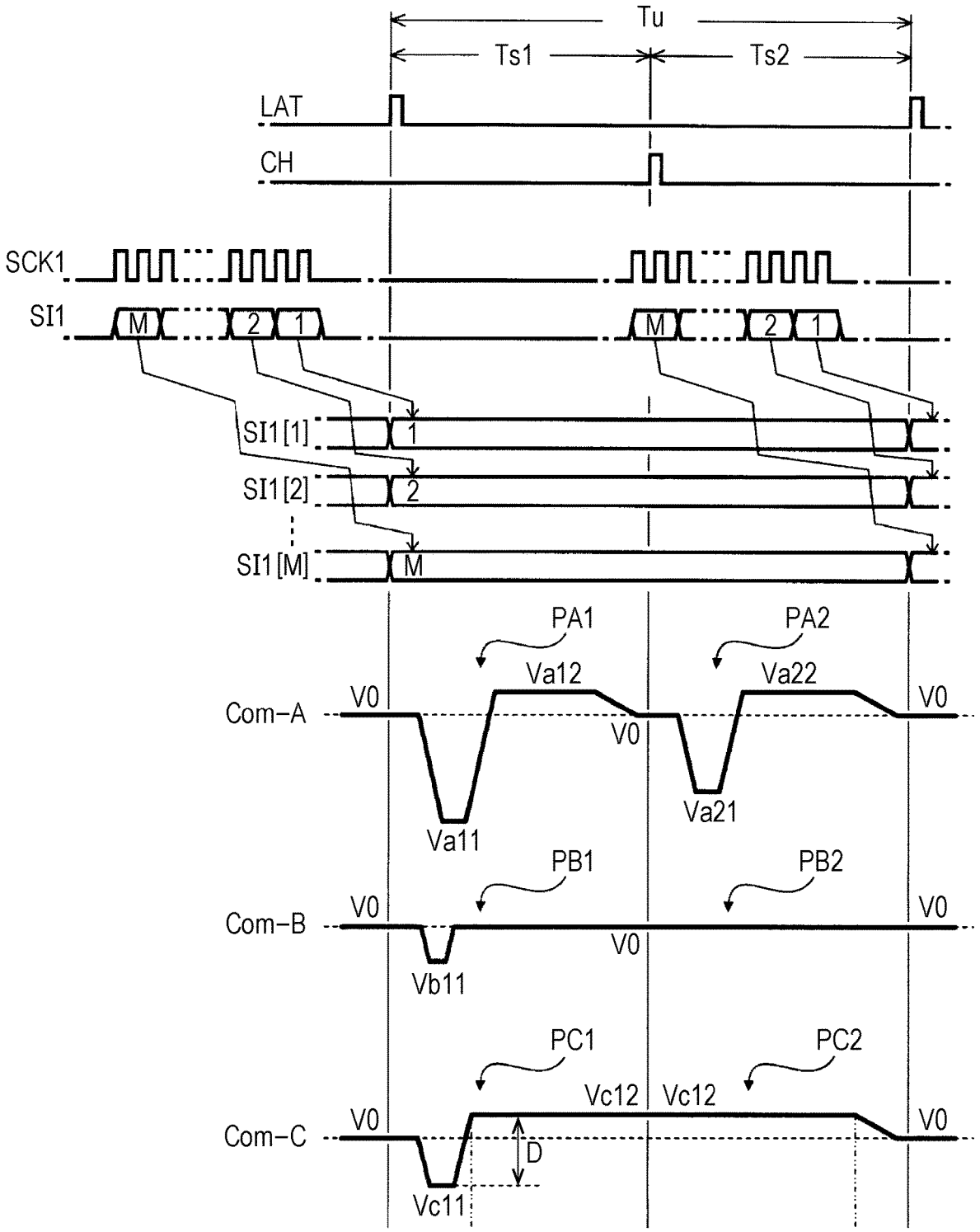
FIG. 9 is a view illustrating an operation of the selection control circuit in a unit operation period.

FIG. 9 is a view illustrating an operation of the selection control circuit 51 in the unit operation period Tu. As illustrated in FIG. 9, the unit operation period Tu is defined by the latch signal LAT. The control periods Ts1 and Ts2 included in the unit operation period Tu are defined by the latch signal LAT and the change signal CH.

The drive signal Com-A in the drive signal COM supplied from the drive signal output circuit 50 is a signal for generating the print drive signal Vin in the unit operation period Tu, and includes a continuous waveform of a unit waveform PA1 disposed in the control period Ts1 and a unit waveform PA2 disposed in the control period Ts2. The potentials at the start timing and end timing of the unit waveform PA1 and the unit waveform PA2 are both reference potentials V0. The potential difference between a potential Va11 and a potential Va12 of the unit waveform PA1 is larger than the potential difference between a potential Va21 and a potential Va22 of the unit waveform PA2. Therefore, when the piezoelectric element 60 is driven by the unit waveform PA1, the amount of ink ejected from the nozzle N corresponding to the piezoelectric element 60 is larger than the amount of ink ejected from the nozzle N when the piezoelectric element 60 is driven by the unit waveform PA2. Here, when the piezoelectric element 60 is driven by the unit waveform PA1, the amount of ink ejected from the nozzle N corresponding to the piezoelectric element 60 is referred to as a medium amount, and when the piezoelectric element 60 is driven by the unit waveform PA2, the amount of ink ejected from the nozzle N corresponding to the piezoelectric element 60 is referred to as a small amount.

The drive signal Com-B of the drive signal COM supplied from the drive signal output circuit 50 in the unit operation period Tu is a signal for generating the drive signal Vin for printing, and has a continuous waveform of a unit waveform PB1 disposed in the control period Ts1 and a unit waveform PB2 disposed in the control period Ts2. The potentials at the start timing and end timing of the unit waveform PB1 are both the reference potential V0, and the potential of the unit waveform PB2 is maintained at the reference potential V0 over the control period Ts2. The potential difference between the potential Vbll of the unit waveform PB1 and the reference potential V0 is smaller than the potential difference between the potential Va21 and the potential Va22 of the unit waveform PA2. When the piezoelectric element 60 corresponding to the nozzle N is driven by the unit waveform PB1, the piezoelectric element 60 is driven to such an extent that ink is not ejected from the corresponding nozzle N. When the unit waveform PB2 is supplied to the piezoelectric element 60, the piezoelectric element 60 is not displaced. Therefore, no ink is ejected from the nozzle N.

The drive signal Com-C of the drive signal COM supplied from the drive signal output circuit 50 in the unit operation period Tu is a signal for generating the drive signal Vin for inspection, and has a continuous waveform of a unit waveform PC1 disposed in the control period Ts1 and a unit waveform PC2 disposed in the control period Ts2. The potential at the start timing of the unit waveform PC1 and the potential at the end timing of the unit waveform PC2 are both the reference potential V0. Further, the unit waveform PC1 transitions from the reference potential V0 to a potential Vc11, transitions from the potential Vc11 to a potential Vc12, and is thereafter kept at the potential Vc12 until the end of the control period Ts1. Further, after maintaining the potential Vc12, the unit waveform PC2 transitions from the potential Vc12 to the reference potential V0 before the control period Ts2 ends.

As illustrated in FIG. 9, the print data signals SI1[1] to SI1[M] supplied as serial signals are sequentially propagated to the shift register SR by the clock signal SCK1 and are held in the corresponding shift registers SR[1] to SR[M] when the clock signal SCK1 stops. Then, at the timing of the rise of the latch signal LAT, that is, the timing at which the unit operation period Tu starts, the M latch circuits LT included in the selection control circuit 51 latch the print data signals SI1[1] to SI1[M] held in the shift registers SR[1] to SR[M].

In each of the control periods Ts1 and Ts2, each of the M decoders DC outputs a selection signal Sa, Sb, and Sc of a logic level corresponding to the print data signals SI1[1] to SI1[M] latched by the latch circuits LT in accordance with the contents illustrated in FIG. 8.

Then, when each of the M transmission gates TGa, TGb, and TGc is controlled to be on or off based on the logic level of the input selection signals Sa, Sb, and Sc, each of the drive signals Com-A, Com-B, and Com-C included in the drive signal COM is selected or deselected. As a result, the drive signal Vin is generated and output.

Figure 10:
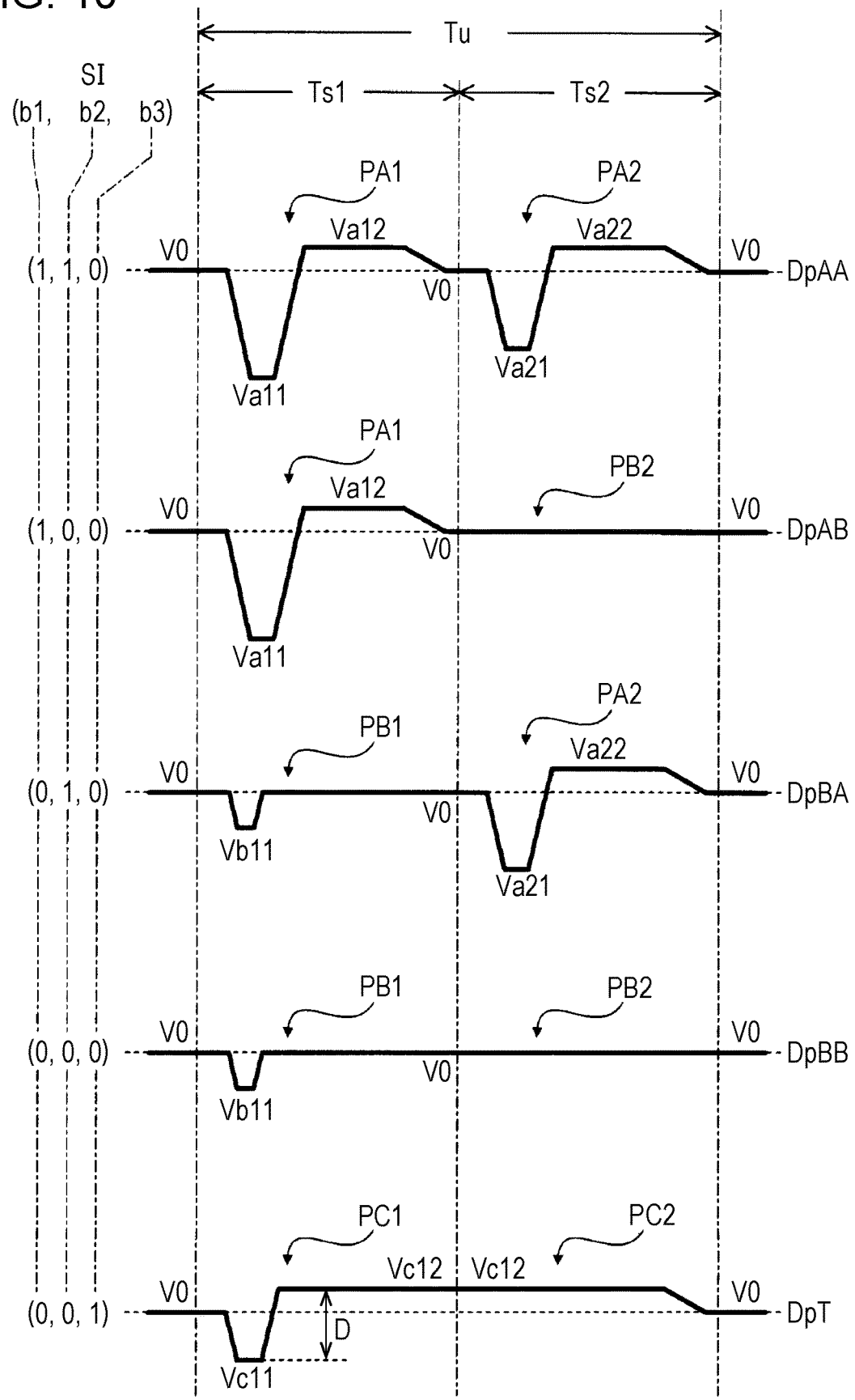
FIG. 10 is a view illustrating an example of a waveform of a drive signal Vin.

Next, an example of the waveform of the drive signal Vin output from the selection control circuit 51 in the unit operation period Tu will be described with reference to FIG. 10. FIG. 10 is a view illustrating an example of a waveform of the drive signal Vin.

When the print data [b1, b2, b3] included in the print data signal SI1 supplied to the selection control circuit 51 in the unit operation period Tu is [1, 1, 0], the decoder DC sets the logic levels of the selection signals Sa, Sb, and Sc in the control period Ts1 to H, L, L levels, and sets the logic levels of the selection signals Sa, Sb, and Sc to H, L, L levels in the control period Ts2. Accordingly, the drive signal Com-A is selected in the control period Ts1, and the drive signal Com-A is selected in the control period Ts2. Therefore, the selection control circuit 51 outputs the drive signal Vin having a continuous waveform of the unit waveform PA1 and the unit waveform PA2 in the unit operation period Tu. As a result, in the unit operation period Tu, a medium amount of ink based on the unit waveform PA1 and a small amount of ink based on the unit waveform PA2 are ejected from the corresponding nozzle N. Then, a large dot is formed on the medium P by combining the ink ejected from the nozzles N on the medium P.

In addition, when the print data [b1, b2, b3] included in the print data signal SI1 supplied to the selection control circuit 51 in the unit operation period Tu is [1, 0, 0], the decoder DC sets the logic levels of the selection signals Sa, Sb, and Sc in the control period Ts1 to H, L, L levels, and sets the logic levels of the selection signals Sa, Sb, and Sc to L, H, L levels in the control period Ts2. Accordingly, the drive signal Com-A is selected in the control period Ts1, and the drive signal Com-B is selected in the control period Ts2. Therefore, the selection control circuit 51 outputs the drive signal Vin having a continuous waveform of the unit waveform PA1 and the unit waveform PB2 in the unit operation period Tu. As a result, a medium amount of ink based on the unit waveform PA1 is ejected from the corresponding nozzle N in the unit operation period Tu, and a medium dot is formed on the medium P.

In addition, when the print data [b1, b2, b3] included in the print data signal SI1 supplied to the selection control circuit 51 in the unit operation period Tu is [0, 1, 0], the decoder DC sets the logic levels of the selection signals Sa, Sb, and Sc in the control period Ts1 to L, H, L levels, and sets the logic levels of the selection signals Sa, Sb, and Sc to H, L, L levels in the control period Ts2. Accordingly, the drive signal Com-B is selected in the control period Ts1, and the drive signal Com-A is selected in the control period Ts2. Therefore, the selection control circuit 51 outputs the drive signal Vin having a continuous waveform of the unit waveform PB1 and the unit waveform PA2 in the unit operation period Tu. As a result, a small amount of ink based on the unit waveform PA2 is ejected from the corresponding nozzle N in the unit operation period Tu, and a small dot is formed on the medium P.

In addition, when the print data [b1, b2, b3] included in the print data signal SI1 supplied to the selection control circuit 51 in the unit operation period Tu is [0, 0, 0], the decoder DC sets the logic levels of the selection signals Sa, Sb, and Sc in the control period Ts1 to L, H, L levels, and sets the logic levels of the selection signals Sa, Sb, and Sc to L, H, L levels in the control period Ts2. Accordingly, the drive signal Com-B is selected in the control period Ts1, and the drive signal Com-B is selected in the control period Ts2. Therefore, the selection control circuit 51 outputs the drive signal Vin having a continuous waveform of the unit waveform PB1 and the unit waveform PB2 in the unit operation period Tu. As a result, no ink is ejected from the corresponding nozzle N in the unit operation period Tu. Therefore, no dots are formed on the medium P. In this case, the drive signal Vin output by the selection control circuit 51 corresponds to a so-called micro-vibration waveform that drives the piezoelectric element 60 to such an extent that ink is not ejected from the nozzles N and prevents the viscosity of the ink near the nozzles from increasing.

In addition, when the print data [b1, b2, b3] included in the print data signal SI1 supplied to the selection control circuit 51 in the unit operation period Tu is [0, 0, 1], the decoder DC sets the logic levels of the selection signals Sa, Sb, and Sc in the control period Ts1 to L, L, H levels, and sets the logic levels of the selection signals Sa, Sb, and Sc to L, L, H levels in the control period Ts2. Accordingly, the drive signal Com-C is selected in the control period Ts1, and the drive signal Com-C is selected in the control period Ts2. Therefore, the selection control circuit 51 outputs the drive signal Vin having a continuous waveform of the unit waveform PC1 and the unit waveform PC2 in the unit operation period Tu. As a result, no ink is ejected from the corresponding nozzle N in the unit operation period Tu. Therefore, no dots are formed on the medium P. In this case, the drive signal Vin output from the selection control circuit 51 corresponds to an inspection waveform for detecting the residual vibration of the piezoelectric element 60.

3.3 Configuration and Operation of Switching Circuit and Detection Circuit

Figure 11:
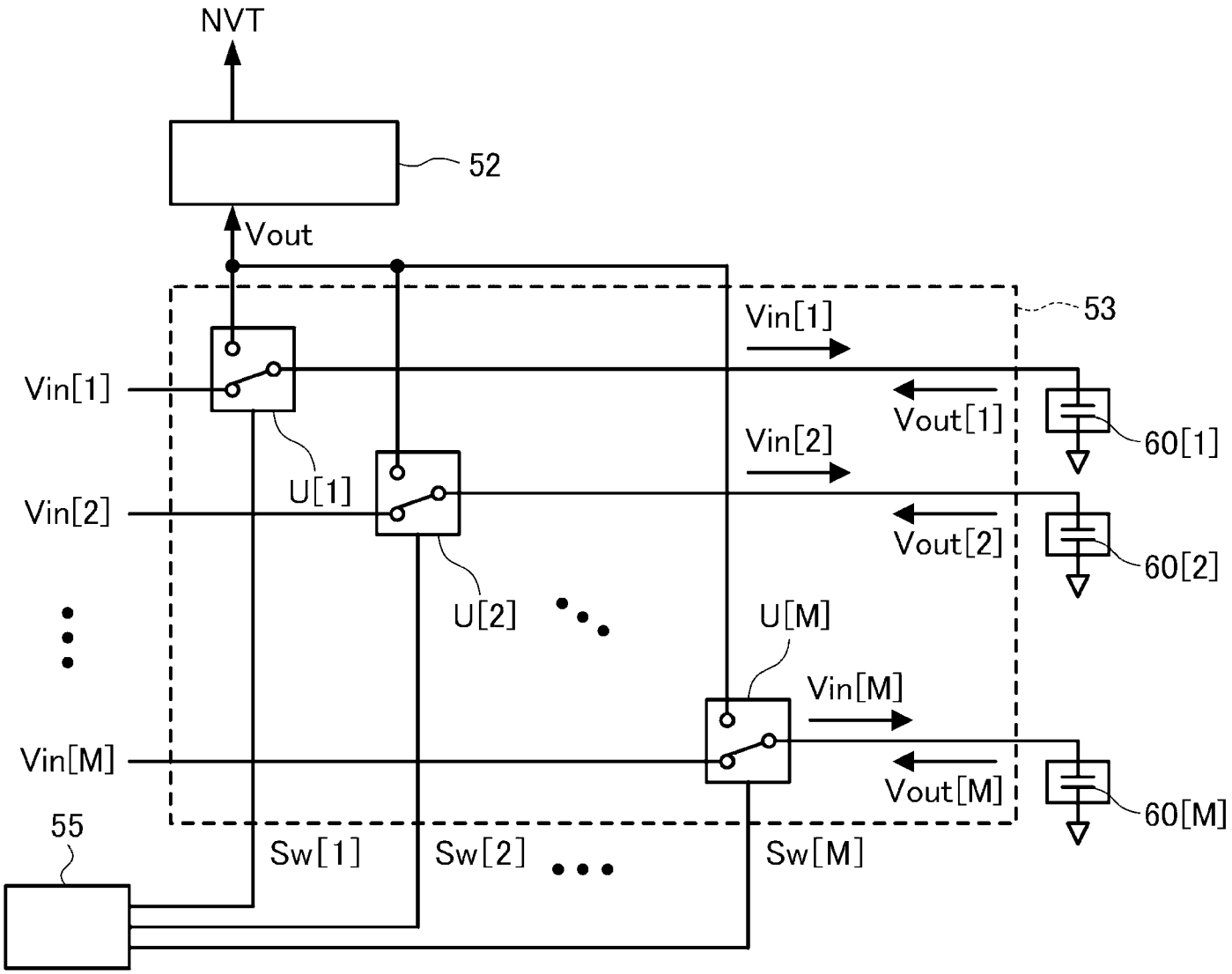
FIG. 11 is a view illustrating an electrical configuration of a switching circuit and a detection circuit.

Next, configurations and operations of the switching circuit 53 and the detection circuit 52 will be described. FIG. 11 is a view illustrating an electrical configuration of the switching circuit 53 and the detection circuit 52. In FIG. 11, the changeover switches U corresponding to stage 1, stage 2, . . . , stage M are denoted by U[1], U[2], . . . , U[M], the piezoelectric element 60 is denoted by 60[1], 60[2], . . . , 60[M], the changeover switch U is denoted by U[1], U[2], . . . , U[M], the switching control signal Sw is denoted by Sw[1], Sw[2], . . . , Sw[M], and the residual vibration Vout is denoted by the residual vibration Vout[1], Vout[2], . . . , Vout[M].

As illustrated in FIG. 11, the switching circuit 53 includes M changeover switches U corresponding to the M piezoelectric elements 60. Each of the changeover switches U between supplying the drive signal Vin input from the selection control circuit 51 to the corresponding piezoelectric element 60 based on the switching control signal Sw and supplying the residual vibration Vout of the piezoelectric element 60 generated after the drive signal Vin is supplied to the piezoelectric element 60 to the detection circuit 52.

Specifically, the switching control signal Sw [1] is input to the changeover switch U [1]. Then, the changeover switch U[1] switches between supplying the drive signal Vin[1] to the piezoelectric element 60 [1] based on the switching control signal Sw[1] and supplying the residual vibration Vout [1] generated in the piezoelectric element 60[1] to the detection circuit 52 after the drive signal Vin [1] is supplied to the piezoelectric element 60[1].

Similarly, the switching control signal Sw [i] is input to the changeover switch U[i]. Then, the changeover switch U[i] switches between supplying the drive signal Vin[i] to the piezoelectric element 60[i] based on the switching control signal Sw[i] and supplying the residual vibration Vout[i] generated in the piezoelectric element 60[i] after the drive signal Vin[i] is supplied to the piezoelectric element 60 [i] to the detection circuit 52.

Here, in the unit operation period Tu, the switching control signals Sw[1] to Sw[M] control the switching of M changeover switches U[1] to U[M] so that one of the M piezoelectric elements 60[1] to 60[M] is electrically coupled to the detection circuit 52. In other words, the detection circuit 52 detects one of the residual vibrations Vout[1] to Vout[M] corresponding to each of the M piezoelectric elements 60[1] to 60[M] based on the switching control signal Sw to generate a residual vibration signal NVT at the corresponding nozzle N. Therefore, the switching control signal Sw only needs to be able to control the M changeover switches U[1] to U[M] to be sequentially turned on, and, for example, the switching control signal Sw output from the timing control circuit 55 may be sequentially propagated by a shift register or the like so that the M changeover switches U are sequentially switched.

Figure 12:
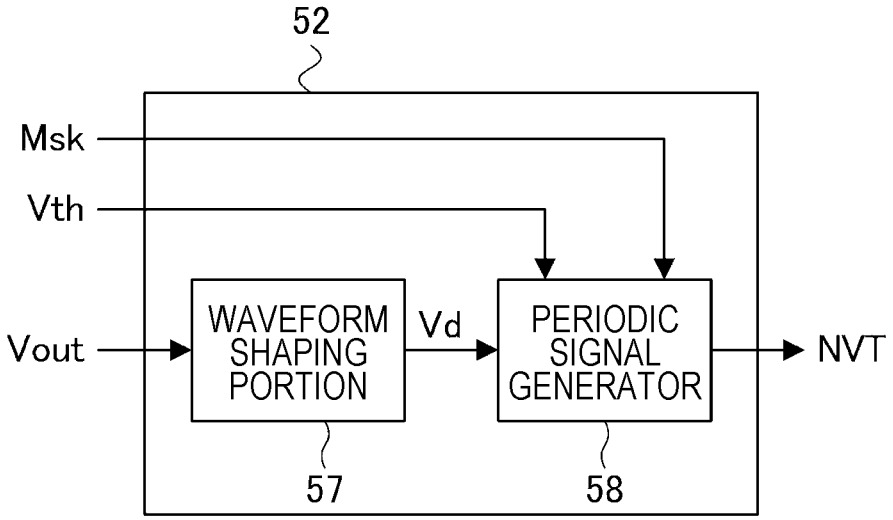
FIG. 12 is a block view illustrating a configuration of the detection circuit.

Next, the configuration of the detection circuit 52 will be described. FIG. 12 is a block view illustrating a configuration of the detection circuit 52. The detection circuit 52 detects the residual vibration Vout, and generates and outputs a residual vibration signal NVT indicating at least one of the cycle of the detected residual vibration Vout and the vibration frequency.

As illustrated in FIG. 12, the detection circuit 52 includes a waveform shaping portion 57 and a periodic signal generator 58. The waveform shaping portion 57 generates a shaped waveform signal Vd obtained by removing noise components from the residual vibration Vout. The waveform shaping portion 57 includes, for example, a high-pass filter for outputting a signal obtained by attenuating frequency components lower than the frequency bandwidth of the residual vibration Vout, a low-pass filter for outputting a signal obtained by attenuating frequency components higher than the frequency bandwidth of the residual vibration Vout. Then, the waveform shaping portion 57 limits the frequency range of the residual vibration Vout and outputs a shaped waveform signal Vd from which noise components have been removed. Further, the waveform shaping portion 57 may include a negative feedback type amplifier circuit for adjusting the amplitude of the residual vibration Vout, a voltage follower circuit for converting the impedance of the residual vibration Vout, and the like.

The periodic signal generator 58 generates and outputs the residual vibration signal NVT indicating the cycle and the vibration frequency of the residual vibration Vout based on the shaped waveform signal Vd. The periodic signal generator 58 receives the shaped waveform signal Vd, a mask signal Msk, and a threshold potential Vth. Here, the mask signal Msk and the threshold potential Vth may be supplied from, for example, any of the controller 10 and the timing control circuit 55 and may be supplied by reading information stored in a storage portion (not illustrated).

Figure 13:
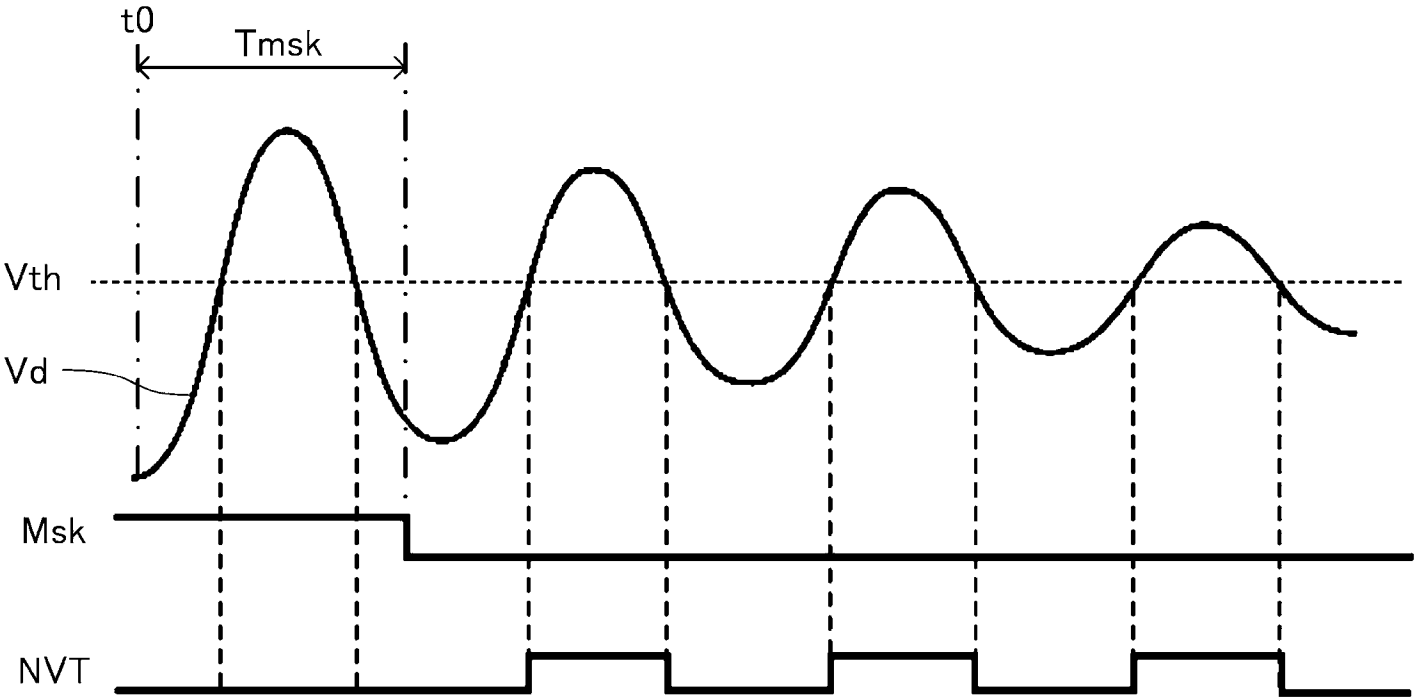
FIG. 13 is a view illustrating an operation of a periodic signal generator.

FIG. 13 is a view illustrating an operation of the periodic signal generator 58. As illustrated in FIG. 13, the threshold potential Vth is a threshold determined at a potential of a predetermined level in the amplitude of the shaped waveform signal Vd, for example, a potential at the center level of the amplitude of the shaped waveform signal Vd. Then, the periodic signal generator 58 generates and outputs the residual vibration signal NVT based on the input shaped waveform signal Vd and the threshold potential Vth.

Specifically, the periodic signal generator 58 compares the potential of the shaped waveform signal Vd with the threshold potential Vth. The periodic signal generator 58 generates a residual vibration signal NVT that becomes the H level when the potential of the shaped waveform signal Vd is equal to or higher than the threshold potential Vth and becomes the L level when the potential of the shaped waveform signal Vd is less than the threshold potential Vth. That is, the period from when the logic level of the residual vibration signal NVT transits from the H level to the L level and becomes the H level again corresponds to the cycle of the residual vibration Vout, and the reciprocal of the cycle corresponds to the vibration frequency.

The mask signal Msk is a signal that becomes the H level only during a predetermined period Tmsk from time tO when the supply of the shaped waveform signal Vd is started. The periodic signal generator 58 stops generating the residual vibration signal NVT while the mask signal Msk is at the H level, and generates the residual vibration signal NVT while the mask signal Msk is at the H level. That is, the periodic signal generator 58 generates the residual vibration signal NVT only for the shaped waveform signal Vd after the elapse of the period Tmsk among the shaped waveform signals Vd. Accordingly, the periodic signal generator 58 can eliminate noise components that are superimposed immediately after the residual vibration Vout occurs and can generate a highly accurate residual vibration signal NVT.

3.4 Configuration of Integrated Circuit Device

Figure 14:
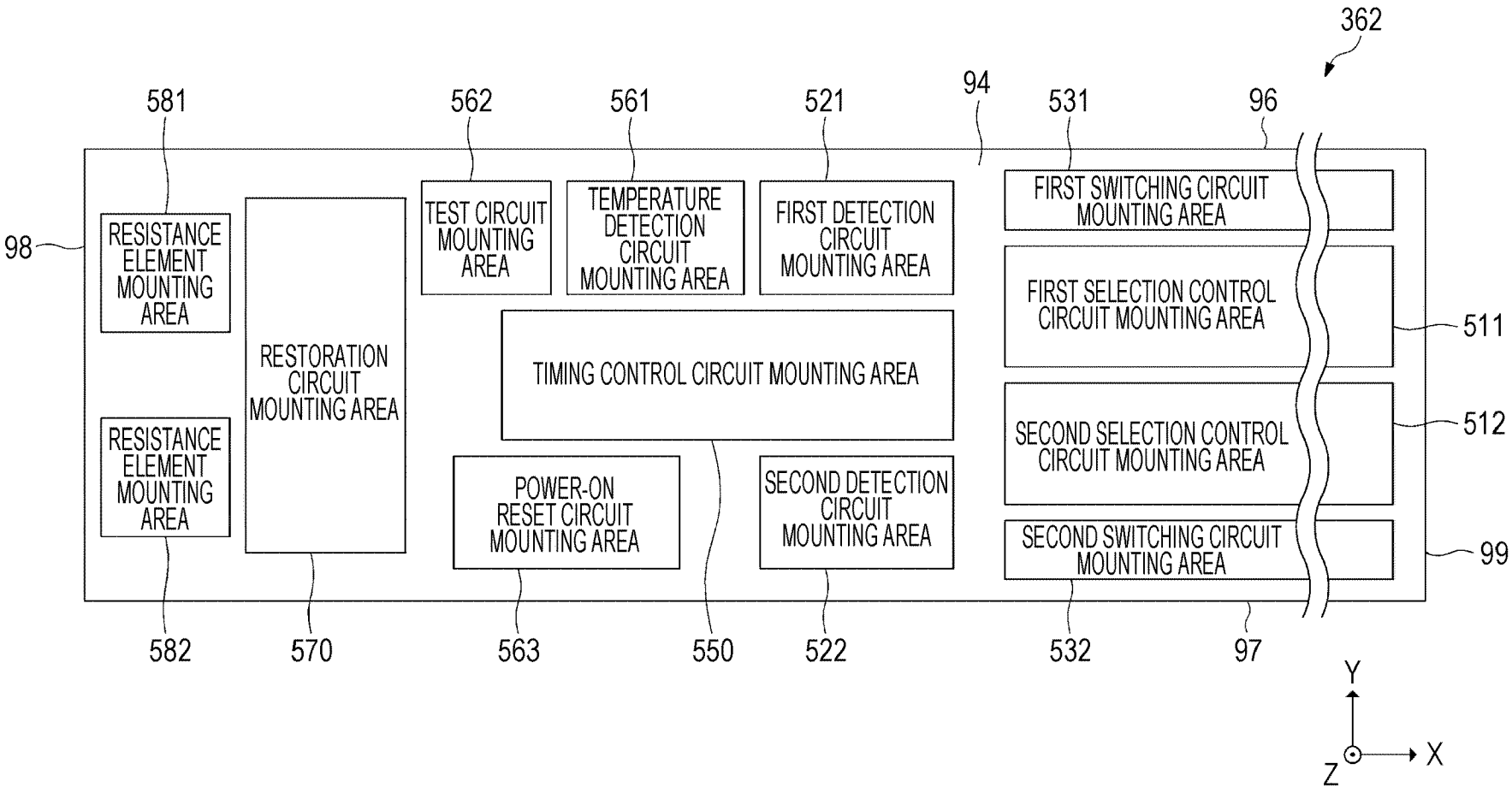
FIG. 14 is a view illustrating a disposition of various circuits mounted on the integrated circuit.
Figure 15:
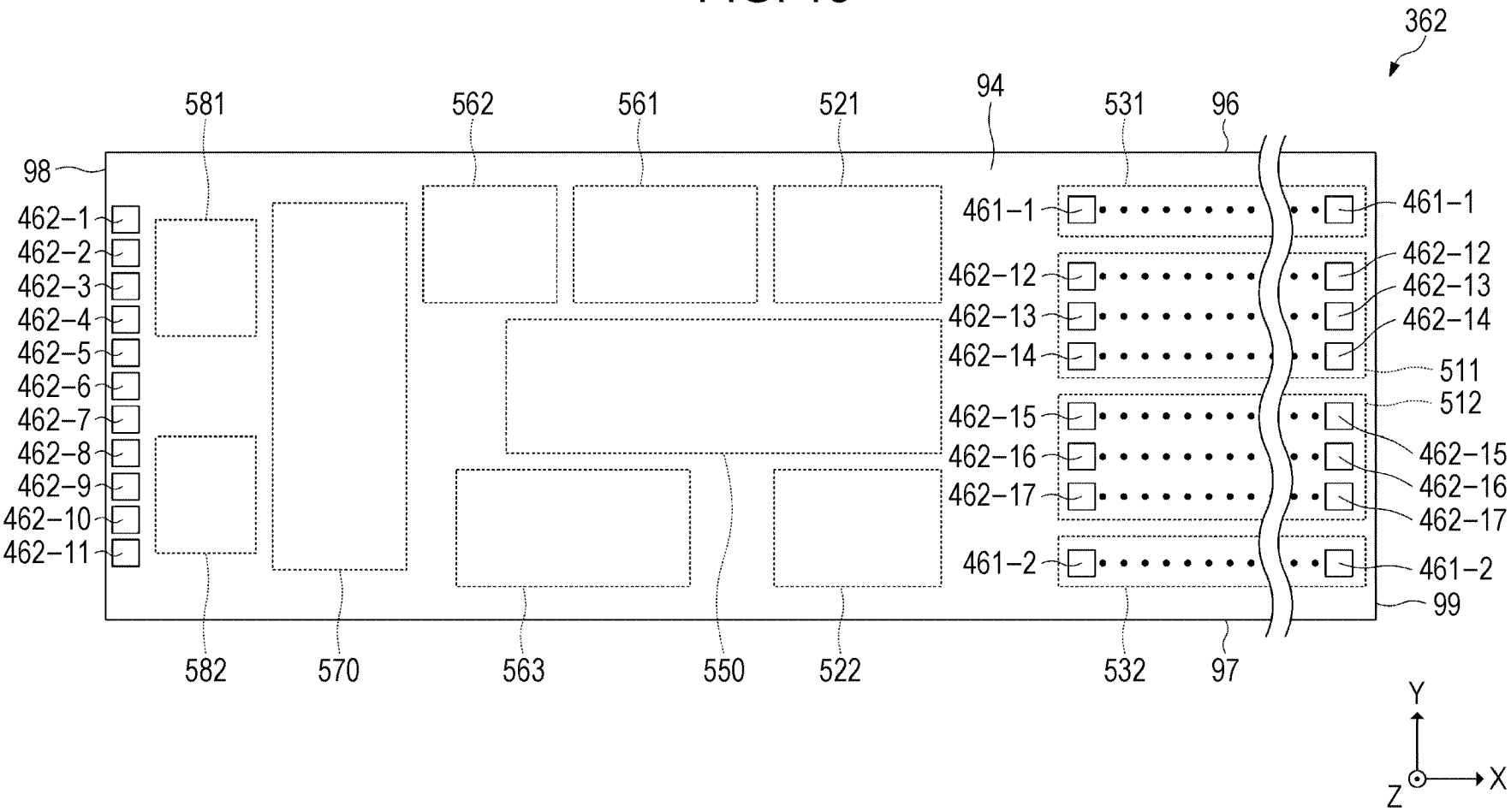
FIG. 15 is a view illustrating a disposition of a plurality of terminals provided in the integrated circuit.
Figure 16:
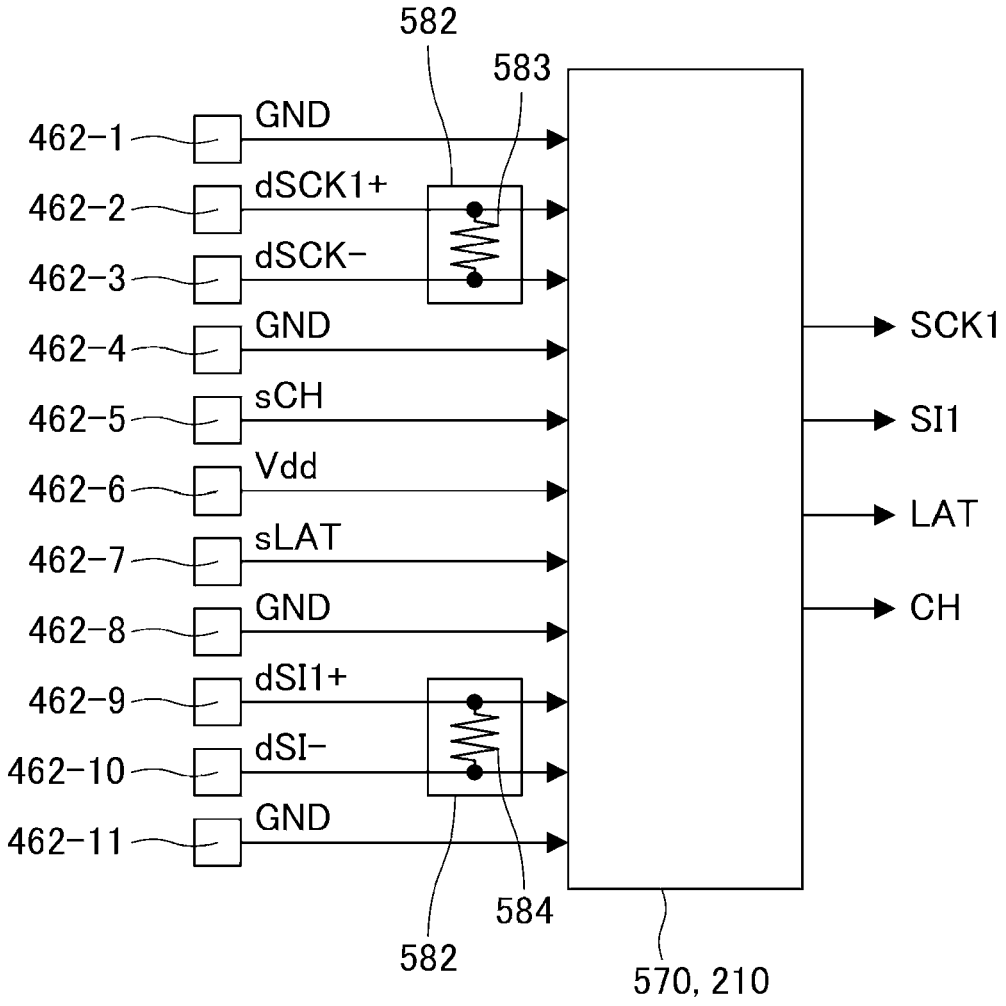
FIG. 16 is a view illustrating an electrical coupling configuration between a terminal of which a differential clock signal dSCK1 and a differential print data signal dSI1 are input to the integrated circuit, and a restoration circuit.

Next, in the integrated circuit 362 described above, a disposition of various circuit components mounted on the integrated circuit 362 and an electrical coupling configuration will be described with reference to FIGS. 14 to 16. FIG. 14 is a view illustrating a disposition of various circuits mounted on the integrated circuit 362. FIG. 15 is a view illustrating a disposition of a plurality of terminals provided in the integrated circuit 362. FIG. 16 is a view illustrating an electrical coupling configuration between a terminal of which the differential clock signal dSCK1 and the differential print data signal dSI1 are input to the integrated circuit 362, and the restoration circuit 210.

Here, FIGS. 14 to 16 illustrate the disposition of areas where various circuits are mounted when the integrated circuit 362 is viewed from the +Z direction, but the various circuits mounted on the integrated circuit 362 are not limited to being mounted on the surface of a substrate 94 of the integrated circuit 362 on the +Z direction side. That is, when various circuits mounted on the integrated circuit 362 are mounted on the surface of the substrate 94 on the +Z direction side, FIGS. 14 to 16 are plan views of the integrated circuit 362, and when various circuits mounted on the integrated circuit 362 are mounted on the surface of the substrate 94 on the −Z direction side, FIGS. 14 to 16 are perspective views of the integrated circuit 362. In addition, the broken line illustrated in FIG. 15 indicates an area where various circuits included in the integrated circuit 362 are mounted.

As illustrated in FIG. 14, the integrated circuit 362 includes the substrate 94. The substrate 94 has sides 96 and 97 facing each other in the Y direction, and sides 98 and 99 facing each other in the X direction. The sides 96 and 97 are longer than the sides 98 and 99, and the sides 96 and 97 intersect the sides 98 and 99. That is, the substrate 94 is on a rectangle having the sides 96 and 97 facing each other as long sides and the sides 98 and 99 facing each other as short sides. In other words, the integrated circuit 362 has the sides 96 and 97, and the sides 98 and 99 that intersect the sides 96 and 97, and the sides 96 and 97 are longer than the sides 98 and 99. Here, at least one of the sides 96 and 97 is an example of a first side, and at least one of the sides 98 and 99 is an example of a second side. In the integrated circuit 362 according to the present embodiment, the long sides 96 and 97 are provided along the same X direction as the direction in which the rows L1 and L2 illustrated in FIG. 3 are formed. In other words, both the long sides 96 and 97 and the direction in which the nozzles N of each of the plurality of ejectors 600 of the print head 35 are arranged in the X direction.

The substrate 94 is an area where the restoration circuit 210, the timing control circuit 55, the first selection control circuit 51-1, the second selection control circuit 51-2, the first detection circuit 52-1, the second detection circuit 52-2, the first switching circuit 53-1, the second switching circuit 53-2, the temperature detection circuit 250, the power-on reset circuit, and the test circuit are mounted, and is provided with a restoration circuit mounting area 570, a timing control circuit mounting area 550, a first selection control circuit mounting area 511, a second selection control circuit mounting area 512, a first detection circuit mounting area 521, a second detection circuit mounting area 522, a first switching circuit mounting area 531, a second switching circuit mounting area 532, a temperature detection circuit mounting area 561, a power-on reset circuit mounting area 563, and a test circuit mounting area 562.

The integrated circuit 362 includes resistance elements 583 and 584 for reducing unnecessary reflection of various signals input to the restoration circuit 210. The substrate 94 is provided with resistance element mounting areas 581 and 582 where the resistance elements 583 and 584 are mounted on the substrate 94.

The resistance element mounting areas 581 and 582 are arranged side by side along the side 98 of the substrate 94 so that the resistance element mounting area 581 is on the side 96 side and the resistance element mounting area 582 is on the side 97 side. The restoration circuit mounting area 570 is located on the side 99 side of the resistance element mounting areas 581 and 582. Also, as illustrated in FIG. 15, terminals 462-1 to 462-11 corresponding to the terminal 462 illustrated in FIG. 5 are arranged side by side along the side 98 from the side 96 to the side 97 on the side 98 side of the two resistance element mounting areas 581 and 582.

Here, a specific example of a signal input from each of the terminals 462-1 to 462-11 will be described with reference to FIG. 16.

The terminal 462-1 is electrically coupled to a wiring through which the ground signal GND propagates among the plurality of wirings included in the cable 190. Then, the terminal 462-1 inputs the ground signal GND to the integrated circuit 362.

The terminal 462-2 is electrically coupled to a wiring through which the differential clock signal dSCK1+ propagates among the plurality of wirings included in the cable 190. Then, the terminal 462-2 inputs the differential clock signal dSCK1+ to the integrated circuit 362. The terminal 462-2 is an example of a first signal input terminal.

The terminal 462-3 is electrically coupled to a wiring through which the differential clock signal dSCK1− propagates among a plurality of wirings included in the cable 190. Then, the terminal 462-3 inputs the differential clock signal dSCK1− to the integrated circuit 362. The terminal 462-3 is an example of a second signal input terminal.

The terminal 462-4 is electrically coupled to a wiring through which the ground signal GND propagates among the plurality of wirings included in the cable 190. Then, the terminal 462-4 inputs the ground signal GND to the integrated circuit 362.

The terminal 462-5 is electrically coupled to a wiring through which the base change signal sCH propagates among the plurality of wirings included in the cable 190. Then, the terminal 462-5 inputs the base change signal sCH to the integrated circuit 362.

The terminal 462-6 is electrically coupled to a wiring through which the voltage VDD propagates among the plurality of wirings included in the cable 190. Then, the terminal 462-6 inputs the voltage VDD to the integrated circuit 362.

The terminal 462-7 is electrically coupled to a wiring through which the base latch signal sLAT propagates among the plurality of wirings included in the cable 190. Then, the terminal 462-7 inputs the base latch signal sLAT to the integrated circuit 362.

The terminal 462-8 is electrically coupled to a wiring through which the ground signal GND propagates among the plurality of wirings included in the cable 190. Then, the terminal 462-8 inputs the ground signal GND to the integrated circuit 362.

The terminal 462-9 is electrically coupled to a wiring through which a differential print data signal dSI+ propagates among the plurality of wirings included in the cable 190. Then, the terminal 462-9 inputs the differential print data signal dSI1+ to the integrated circuit 362. This terminal 462-9 is another example of a first signal input terminal.

The terminal 462-10 is electrically coupled to a wiring through which a differential print data signal dSI− propagates among the plurality of wirings included in the cable 190. Then, the terminal 462-10 inputs the differential print data signal dSI1- to the integrated circuit 362. This terminal 462-10 is another example of the second signal input terminal.

The terminal 462-11 is electrically coupled to a wiring through which the ground signal GND propagates among the plurality of wirings included in the cable 190. Then, the terminal 462-11 inputs the ground signal GND to the integrated circuit 362.

As described above, the signal input from each of the terminals 462-1 to 462-11 propagates through a wiring (not illustrated) provided on the substrate 94 and is input to the restoration circuit 210. In other words, the restoration circuit 210 is electrically coupled to each of the terminals 462-1 to 462-11.

As described above, each of terminals 462-1 to 462-11 for inputting various signals to the integrated circuit 362 is such that the terminal 462-2 to which the differential clock signal dSCK1+ is input and the terminal 462-1 to which the ground signal GND is input are located adjacent to each other, the terminal 462-3 to which the differential clock signal dSCK1− is input and the terminal 462-4 to which the ground signal GND is input are located adjacent to each other, the terminal 462-9 to which the differential print data signal dSI1+ is input and the terminal 462-8 to which the ground signal GND is input are located adjacent to each other, and the terminal 462-10 to which the differential print data signal dSI1+ is input and the terminal 462-11 to which the ground signal GND is input are located adjacent to each other. That is, a pair of terminals to which a pair of differential clock signals dSCK1 is input are located adjacent to the terminal to which the ground signal GND is input, and a pair of terminals to which a pair of differential print data signals dSI1 is input are located adjacent to a terminal to which the ground signal GND is input.

As described above, the terminal to which the ground signal GND is input functions as a shield by locating the terminal to which the ground signal GND is input adjacent to the terminals to which a pair of differential clock signals dSCK1 is input and the terminals to which the pair of differential print data signals dSI1 is input. As a result, the possibility that noise is superimposed on the pair of differential clock signals dSCK1 and the pair of differential print data signals dSI1 is reduced. The ground signal GND has a stable potential in the integrated circuit 362, and the distance between the terminals can be reduced by providing the terminals to which a pair of differential clock signals dSCK1 is input, the terminal to which the pair of differential print data signals dSI1 is input, and the terminal to which the ground signal GND is input adjacent to each other. As a result, the size of the integrated circuit 362 can be reduced. A signal having a constant voltage may be input to the terminal to which the ground signal GND is input. Also in this configuration, the same effect as when the ground signal GND is input can be obtained.

Further, in each of the terminals 462-1 to 462-11 for inputting various signals to the integrated circuit 362, the terminal 462-2 to which the differential clock signal dSCK1+ is input and the terminal 462-3 to which the differential clock signal dSCK1− is input are located between the terminal 462-1 to which the ground signal GND is input and the terminals 462-4 to which the ground signal GND is input, and the terminal 462-9 to which the differential print data signal dSI1+ is input and the terminal 462-10 to which the differential print data signal dSI1+ is input are located between the terminal 462-8 to which the ground signal GND is input and the terminal 462-11 to which the ground signal GND is input.

As described above, it is possible to further reduce the noise that is superimposed on the pair of differential clock signals dSCK1 and the pair of differential print data signals dSI1 by locating the pair of terminals to which the pair of differential clock signals dSCK1 is input, and the pair of terminals to which the pair of differential print data signals dSI1 is input so as to be surrounded by the terminals to which the ground signal GND is input.

The terminal 462-6 to which the voltage VDD is input is located between the terminal 462-1 to which the ground signal GND is input and the terminal 462-8 to which the ground signal GND is input.

In this manner, It is possible to reduce the noise that is superimposed on the voltage VDD by locating the terminal to which the voltage VDD which is the power supply voltage of the integrated circuit 362 is input so as to be surrounded by the terminals to which the ground signal GND is input, and when noise is superimposed on the voltage VDD, it is possible to reduce the possibility that noise superimposed on the voltage VDD is superimposed on the pair of differential clock signals dSCK1 and the pair of differential print data signals dSI1.

As described above, signals including the differential clock signal dSCK1, the differential print data signal dSI1, the base latch signal sLAT, and the base change signal sCH are input to the integrated circuit 362 via the terminals 462-1 to 462-11. The various signals input to the integrated circuit 362 are input to the restoration circuit 210 by propagating through the wiring formed on the substrate 94, and are output to the timing control circuit 55 after being converted into a clock signal SCK1, a print data signal SI1, a latch signal LAT, and a change signal CH.

In the substrate 94, the resistance element 583 mounted on the resistance element mounting area 581 is electrically coupled to a wiring for electrically coupling the terminal 462-2 to which the differential clock signal dSCK1+ is input and the restoration circuit mounting area 570 on which the restoration circuit 210 is mounted and a wiring for electrically coupling the terminal 462-3 to which the differential clock signal dSCK1− is input and the restoration circuit mounting area 570 where the restoration circuit 210 is mounted, and the resistance element 584 mounted on the resistance element mounting area 582 is electrically coupled to a wiring for electrically coupling the terminal 462-9 to which the differential print data signal dSI1+ is input and the restoration circuit mounting area 570 where the restoration circuit 210 is mounted and a wiring for electrically coupling the terminal 462-10 to which the differential print data signal dSI1− is input and the restoration circuit mounting area 570 where the restoration circuit 210 is mounted.

The resistance elements 583 and 584 function as termination resistors for reducing unnecessary reflection generated in the pair of differential clock signals dSCK and the pair of differential print data signals dSI1 input to the restoration circuit 210. By forming the resistance elements 583 and 584 functioning as such termination resistors inside the integrated circuit 362, unnecessary reflection can be reduced immediately before the pair of differential clock signals dSCK and the pair of differential print data signals dSI1 is input to the restoration circuit 210, and the signal quality of the pair of differential clock signals dSCK and the pair of differential print data signals dSI1 input to the restoration circuit 210 can be improved.

Further, in the configuration in which the integrated circuit 362 is electrically coupled by the bump electrodes 443 and 444 as illustrated in the present embodiment, it is difficult to provide a termination resistor near the integrated circuit 362, but as described above, by forming the resistance elements 583 and 584 functioning as a termination resistor inside the integrated circuit 362, even if the integrated circuit 362 is electrically coupled to the bump electrodes 443 and 444, a termination resistor can be provided near the restoration circuit 210.

Here, a wiring that electrically couples the terminal 462-2 formed on the substrate 94 to which the differential clock signal dSCK1+ is input and the restoration circuit mounting area 570 on which the restoration circuit 210 is mounted is an example of a first wiring, and a wiring that electrically couples the terminal 462-3 to which the differential clock signal dSCK1− is input and the restoration circuit mounting area 570 on which the restoration circuit 210 is mounted is an example of a second wiring. Further, a wiring that electrically couples the terminal 462-9 to which the differential print data signal dSI1+ is input and the restoration circuit mounting area 570 on which the restoration circuit 210 is mounted is another example of the first wiring. Another example of the second wiring is a wiring that electrically couples the terminal 462-10 to which the differential print data signal dSI1– is input and the restoration circuit mounting area 570 where the restoration circuit 210 is mounted.

Further, the resistance value of the resistance element 583 mounted on the resistance element mounting area 581 and the resistance value of the resistance element 584 mounted on the resistance element mounting area 582 on the substrate 94 can be changeable at random, and for example, the resistance value of the resistance element 583 and the resistance value of the resistance element 584 can be changeable by setting a register inside the integrated circuit 362. Therefore, when a plurality of integrated circuits 362 are mounted on the head unit 30, such as when the head unit 30 includes a plurality of print heads 35, the resistance values of the resistance elements 583 and 584 of any integrated circuit 362 in the plurality of integrated circuits 362 and the resistance values of the resistance elements 583 and 584 of a different integrated circuit 362 in the plurality of integrated circuits 362 may be different.

When the head unit 30 includes a plurality of print heads 35, the pair of differential clock signals dSCK and the pair of differential print data signals dSI1 have different wiring lengths to propagate for the integrated circuit 362 included in each of the plurality of print heads 35. By having a configuration in which the resistance value of the resistance element 583 mounted on the resistance element mounting area 581 and the resistance value of the resistance element 584 mounted on the resistance element mounting area 582 can be changeable at random, an optimum resistance value can be selected for each of the plurality of integrated circuits 362 and the signal quality of the pair of differential clock signals dSCK and the pair of differential print data signals dSI1 input to the restoration circuit 210 can be further improved.

As a method of changing the resistance values of the resistance elements 583 and 584, in addition to the above-described control by the register, for example, the integrated circuit 362 may be manufactured by using a mask having different resistance values of the resistance elements 583 and 584. Further, the resistance value of the resistance element 583 included in one integrated circuit 362 may be different from the resistance value of the resistance element 584. Here, any one of the integrated circuits 362 included in each of the plurality of print heads 35 is an example of a first integrated circuit, and any other one of the integrated circuits 362 included in each of the plurality of print heads 35 is an example of a second integrated circuit.

Returning to FIG. 14, on the side 99 side of the restoration circuit mounting area 570, the temperature detection circuit mounting area 561, the test circuit mounting area 562, the power-on reset circuit mounting area 563, the first detection circuit mounting area 521, the second detection circuit mounting area 522, and the timing control circuit mounting area 550 are located.

Specifically, in the area on the side 99 side of the restoration circuit mounting area 570 and on the side 96 side, the temperature detection circuit mounting area 561, the test circuit mounting area 562, and the first detection circuit mounting area 521 extend from the side 98 to the side 99, and the test circuit mounting area 562, the temperature detection circuit mounting area 561, and the first detection circuit mounting area 521 are arranged side by side in this order. Further, in the area on the side 99 side of the restoration circuit mounting area 570 and on the side 97 side, the power-on reset circuit mounting area 563 and the second detection circuit mounting area 522 extend from the side 98 to the side 99, and the power-on reset circuit mounting area 563 and the second detection circuit mounting area 522 are arranged side by side in this order.

In addition, the timing control circuit mounting area 550 is located between the area on the side 99 side of the restoration circuit mounting area 570 where the test circuit mounting area 562, the temperature detection circuit mounting area 561, and the first detection circuit mounting area 521 are mounted and the area where the power-on reset circuit mounting area 563 and the second detection circuit mounting area 522 are mounted.

Here, each of the temperature detection circuit mounting area 561, the test circuit mounting area 562, the power-on reset circuit mounting area 563, the first detection circuit mounting area 521, the second detection circuit mounting area 522, and the timing control circuit mounting area 550 includes a terminal for inputting a signal from outside the integrated circuit 362 and outputting a signal to the outside of the integrated circuit 362. The terminal has a configuration corresponding to the terminal 462 illustrated in FIG. 5 and is electrically coupled to the wiring substrate 338 via the bump electrode 444.

As illustrated in FIG. 14, on the side 99 side of the area where the first detection circuit mounting area 521, the second detection circuit mounting area 522, and the timing control circuit mounting area 550 are mounted, the first switching circuit mounting area 531, the second switching circuit mounting area 532, the first selection control circuit mounting area 511, and the second selection control circuit mounting area 512 are located.

Specifically, the first switching circuit mounting area 531 is located in the area on the side 99 side of the area where the first detection circuit mounting area 521, the second detection circuit mounting area 522, and the timing control circuit mounting area 550 are mounted and on the side 96 side, and the first selection control circuit mounting area 511 is located on the side 97 side of the first switching circuit mounting area 531. Then, the second selection control circuit mounting area 512 is located on the side 97 side of the first selection control circuit mounting area 511, and the second switching circuit mounting area 532 is located on the side 97 side of the second selection control circuit mounting area 512.

In other words, the first switching circuit mounting area 531, the second switching circuit mounting area 532, the first selection control circuit mounting area 511, and the second selection control circuit mounting area 512 are arranged side by side on the side 99 side of the area where the first detection circuit mounting area 521, the second detection circuit mounting area 522, and the timing control circuit mounting area 550 are mounted in the order of the first switching circuit mounting area 531 extending from side 96 to side 97, the first selection control circuit mounting area 511, the second selection control circuit mounting area 512, the second switching circuit mounting area 532.

Here, the first selection control circuit 51-1 mounted in the first selection control circuit mounting area 511 generates the drive signal Vin1 by selecting or deselecting the drive signal COM input from the drive signal output circuit 50 based on the clock signal SCK1*a*, the print data signal SI1*a*, the latch signal LATa, and the change signal CHa input from the timing control circuit 55 as described above. Similarly, the second selection control circuit 51-2 mounted in the second selection control circuit mounting area 512 generates the drive signal Vin2 by selecting or deselecting the drive signal COM input from the drive signal output circuit 50 based on the clock signal SCK1*b*, the print data signal SI1*b*, the latch signal LATb, and the change signal CHb input from the timing control circuit 55 as described above. The first selection control circuit mounting area 511 and the second selection control circuit mounting area 512 where the first selection control circuit 51-1 and the second selection control circuit 51-2 are mounted are provided with terminals 462-12 to 462-17, which are electrically coupled to the wiring through which the drive signal COM propagates among the plurality of wirings included in the cable 190 and receive the drive signal COM.

As illustrated in FIG. 15, in the first selection control circuit mounting area 511 and the second selection control circuit mounting area 512, each of the terminals 462-12 to 462-17 to which the drive signal COM is input is provided along the side 96 from the side 98 to the side 99.

Specifically, on the side 96 side of the first selection control circuit mounting area 511, the same number of terminals 462-12 as the number of the ejectors 600 included in the row L1 of the print head 35 are arranged side by side from the side 98 to the side 99. Further, on the side 97 side of a plurality of terminals 462-12 arranged in parallel, the same number of terminals 462-13 as the number of the ejectors 600 included in the row L1 of the print head 35 are arranged side by side from the side 98 to the side 99. Further, on the side 97 side of a plurality of terminals 462-13 arranged in parallel, the same number of terminals 462-14 as the number of the ejectors 600 included in the row L1 of the print head 35 are arranged side by side from the side 98 to the side 99. Here, one of the drive signals Com-A, Com-B, and Com-C of the drive signal COM is input to each of the plurality of terminals 462-12, a different one of the drive signals Com-A, Com-B, and Com-C of the drive signal COM is input to each of the plurality of terminals 462-13, and another different one of the drive signals Com-A, Com-B, and Com-C of the drive signal COM is input to each of a plurality of terminals 462-14.

Further, on the side 97 side of the second selection control circuit mounting area 512, the same number of terminals 462-17 as the number of the ejectors 600 included in the row L2 of the print head 35 are arranged side by side from the side 98 to the side 99. Further, on the side 96 side of a plurality of terminals 462-17 arranged in parallel, the same number of terminals 462-16 as the number of the ejectors 600 included in the row L2 of the print head 35 are arranged side by side from the side 98 to the side 99. Further, on the side 96 side of a plurality of terminals 462-16 arranged in parallel, the same number of terminals 462-15 as the number of the ejectors 600 included in the row L2 of the print head 35 are arranged side by side from the side 98 to the side 99. Here, one of the drive signals Com-A, Com-B, and Com-C of the drive signal COM is input to each of the plurality of terminals 462-17, a different one of the drive signals Com-A, Com-B, and Com-C of the drive signal COM is input to each of the plurality of terminals 462-16, and another different one of the drive signals Com-A, Com-B, and Com-C of the drive signal COM is input to each of a plurality of terminals 462-15.

As described above, the first selection control circuit 51-1 mounted in the first selection control circuit mounting area 511 and the second selection control circuit 51-2 mounted in the second selection control circuit mounting area 512 are electrically coupled to the terminals 462-12 to 462-17 to which the drive signal COM is input and the restoration circuit 210, and output the drive signals Vin1 and Vin2 based on the clock signals SCK1*a* and SCK1*b*, the print data signals SI1*a* and SI1*b*, the latch signals LATa and LATb, the change signals CHa and CHb, and the drive signal COM input from the timing control circuit 55. Here, at least one of the terminals 462-12 to 462-17 to which the drive signal COM is input is an example of the drive signal input terminal.

In addition, the first switching circuit 53-1 mounted in the first switching circuit mounting area 531 switches between supplying the drive signal Vin1 output from the first selection control circuit 51-1 to the piezoelectric element 60 based on the switching control signal Swa input from the timing control circuit 55 as described above and inputting the residual vibration Vout1 generated after the piezoelectric element 60 is driven to the first detection circuit 52-1. Similarly, the second switching circuit 53-2 mounted in the second switching circuit mounting area 532 switches between supplying the drive signal Vin2 output from the second selection control circuit 51-2 to the piezoelectric element 60 based on the switching control signal Swb input from the timing control circuit 55 as described above and inputting the residual vibration Vout2 generated after the piezoelectric element 60 is driven to the second detection circuit 52-2. Therefore, the first switching circuit mounting area 531 where the first switching circuit 53-1 and the second switching circuit 53-2 are mounted, and the second switching circuit mounting area 532 are provided with terminals 461-1 and 461-2 for outputting the drive signal Vin and receiving the residual vibration Vout.

As illustrated in FIG. 15, in the first switching circuit mounting area 531, the terminals 461-1 that output the drive signal Vin1 and receive the residual vibration Vout1 are arranged side by side from the side 98 to the side 99 along the side 96, and in the second switching circuit mounting area 532, the terminals 461-2 that output the drive signal Vin2 and receive the residual vibration Vout2 are arranged side by side from the side 98 to the side 99 along the side 97.

Specifically, the same number of terminals 461-1 as the number of the ejectors 600 included in the row L1 of the print head 35 are arranged side by side from the side 98 to the side 99 along the side 96 in the first switching circuit mounting area 531. Then, each of the plurality of terminals 461-1 outputs the drive signal Vin1 to the corresponding piezoelectric element 60 of the ejector 600, and receives the residual vibration Vout1 generated by supplying the drive signal Vin1 to the piezoelectric element 60. In addition, the same number of terminals 461-2 as the number of the ejectors 600 included in the row L2 of the print head 35 are arranged from the side 98 to the side 99 along the side 97 in the second switching circuit mounting area 532. Then, each of the plurality of terminals 461-2 outputs the drive signal Vin2 to the corresponding piezoelectric element 60 of the ejector 600, and receives the residual vibration Vout2 generated by supplying the drive signal Vin2 to the piezoelectric element 60.

Here, the terminal 461-1 that is electrically coupled to the first selection control circuit 51-1 and outputs the drive signal Vin1 to the ejector 600 is an example of a drive signal output terminal, and the terminal 461-2 that is electrically coupled to the second selection control circuit 51-2 and outputs the drive signal Vin2 to the ejector 600 is another example of the drive signal output terminal.

As described above, in the integrated circuit 362 included in the head unit 30 included in the liquid ejecting apparatus 1 according to the present embodiment, in the direction along the side 96 of the integrated circuit 362 and in the X direction in which the rows L1 and L2 of the print head 35 are formed, an area where the terminals 462-1 to 462-11 where various signals are input to integrated circuit 362 are located, the restoration circuit mounting area 570 on which the restoration circuit 210 is mounted, the temperature detection circuit mounting area 561, the test circuit mounting area 562, and the power-on reset circuit mounting area 563 on which the temperature detection circuit 250, the test circuit, and the power-on reset circuit, which are a low-frequency circuit, are mounted, respectively, the first detection circuit mounting area 521 and the second detection circuit mounting area 522 on which the first and second detection circuits 52-1 and 52-2 are mounted, respectively, and the first selection control circuit mounting area 511 and the second selection control circuit mounting area 512 on which the first selection control circuit 51-1 and the second selection control circuit 51-2 are mounted, respectively, are arranged side by side in a direction along the X direction.

That is, as illustrated in FIG. 14, in the integrated circuit 362, the terminals 462-1 to 462-11 to which various signals are input, the restoration circuit 210, a low-frequency circuit including the temperature detection circuit 250, the test circuit, and the power-on reset circuit, the first detection circuit 52-1 and second detection circuit 52-2, the first selection control circuit 51-1 and second selection control circuit 51-2 are arranged side by side in order in the direction along the sides 96 and 97, from the side 98 side, in the integrated circuit 362.

In other words, the first and second detection circuits 52-1 and 52-2 are located between the restoration circuit 210 and the first and second selection control circuit 51-1 and 51-2, and the low-frequency circuit is between the restoration circuit 210 and the first and second detection circuits 52-1 and 52-2 and located between the restoration circuit 210 and the first and second selection control circuits 51-1 and 51-2.

In the integrated circuit 362 configured as described above, the terminals 462-1 to 462-11 to which various signals are input, the restoration circuit 210, a low-frequency circuit, the first detection circuit 52-1 and second detection circuit 52-2, the first selection control circuit 51-1 and second selection control circuit 51-2 are arranged side by side in order in the direction along the sides 96 and 97, from the side 98 side, in the integrated circuit 362. Thus, in the integrated circuit 362, signals input from the terminals 462-1 to 462-11 propagate from the side 98 to the side 99 in the direction along the sides 96 and 97, and are input to the first selection control circuit 51-1 and the second selection control circuit 51-2. Then, the first selection control circuit 51-1 and the second selection control circuit 51-2 generate the drive signal Vin based on the signal and the drive signal COM input from the terminals 462-12 to 462-17 and output the same from the terminals 461-1 and 461-2 located in the first switching circuit mounting area 531 and the second switching circuit mounting area 532 provided on the side 99 side. That is, in the integrated circuit 362, a signal for generating the drive signal Vin propagates from the side 98 to the side 99. As a result, the complexity of wiring inside the integrated circuit 362 is reduced, and the size of the integrated circuit 362 can be reduced.

Here, in the integrated circuit 362, the distance between the restoration circuit 210 and the first and second detection circuits 52-1 and 52-2 is preferably shorter than the distance between the first and second detection circuits 52-1 and 52-2 and the first and second selection control circuits 51-1 and 51-2.

A high-voltage signal based on the drive signal COM propagates to the first selection control circuit 51-1 and the second selection control circuit 51-2. On the other hand, the residual vibration Vout input to the first and second detection circuits 52-1 and 52-2, and the voltage value of the residual vibration signal NVT output from the first and second detection circuits 52-1 and 52-2 is low. It is possible to reduce the possibility that noise based on the high-voltage drive signal COM is superimposed on the first and second detection circuits 52-1 and 52-2 by locating the first and second detection circuits 52-1 and 52-2 closer to the restoration circuit 210 through which the low-voltage differential clock signal dSCK1 and the differential print data signal dSI1 propagate than the first selection control circuit 51-1 and the second selection control circuit 51-2 through which a high-voltage signal propagates. Therefore, in the print head 35, it is possible to increase the accuracy of detecting whether or not an ejection abnormality has occurred.

Further, in the integrated circuit 362, the distance between the terminals 462-1 to 462-11 where various signals are input to the integrated circuit 362 and the restoration circuit 210 is preferably shorter than the distance between the terminals 462-1 to 462-11 where various signals are input to the integrated circuit 362 and the terminals 462-12 to 462-17 to which the drive signal COM is input and shorter than the distance between the terminals 462-1 to 462-11 where various signals are input to integrated circuit 362 and the terminals 461-1 and 461-2 from which the drive signals Vin1 and Vin2 are output.

While low-voltage signals such as the differential clock signal dSCK1 and the differential print data signal dSI1 input to the restoration circuit 210 are input to the terminals 462-1 to 462-11, a high-voltage signal based on the drive signal COM is input to or output from the terminals 462-12 to 462-17 and the terminals 461-1 and 461-2. By shorten the distance between the terminals 462-1 to 462-11 to which the low-voltage signal is input and the restoration circuit 210 and increasing the distance between the terminals 462-1 to 462-11 to which the low-voltage signal is input and the terminals 462-12 to 462-17 and the terminals 461-1 and 461-2 which the high-voltage signal is input to or output from, it is possible to reduce the possibility that signals input or output from the terminals 462-12 to 462-17 and the terminals 461-1 and 461-2 are superimposed as noise on signals input from the terminals 462-1 to 462-11.

4. Operational Effects

As described above, the integrated circuit 362 included in the liquid ejecting apparatus 1 according to the present embodiment includes the terminals 462-2 and 462-3 to which the pair of differential clock signals dSCK1 is input, the terminals 462-9 and 462-10 to which a pair of differential print data signals dSI1 is input, the restoration circuit 210 that is electrically coupled to the terminals 462-2, 462-3, 462-9, and 462-10, converts a pair of differential clock signals dSCK1 into a clock signal SCK1, and converts a pair of differential print data signals dSI1 into a print data signal SI1, and the selection control circuit 51 that generates a drive signal Vin to be supplied to the ejector 600 based on the drive signal COM and a plurality of signals including the clock signal SCK1 and the print data signal SI1 converted by the restoration circuit 210. That is, for the integrated circuit 362, the restoration circuit 210 for converting a differential signal for controlling ink ejection to a single-ended signal for controlling ink ejection, and the selection control circuit 51 for controlling ink ejection are mounted on one integrated circuit 362. Therefore, the number of integrated circuit devices included in the head unit 30 can be reduced. Therefore, in the drive circuit and the liquid ejecting apparatus 1 provided with the integrated circuit 362 according to the present embodiment, it is possible to reduce the possibility that the scale of the circuit provided in the head unit 30 increases.

In addition, in the integrated circuit 362 included in the liquid ejecting apparatus 1 according to the present embodiment, the resistance element 583 is coupled between the wirings coupling the terminals 462-2 and 462-3 to which the pair of differential clock signals dSCK1 is input and the restoration circuit 210, and the resistance element 584 is coupled between wirings coupling the terminals 462-9 and 462-10 to which the pair of differential print data signals dSI1 is input and the restoration circuit 210. The resistance elements 583 and 584 provided between the wirings through which such a pair of differential signals is propagated function as termination resistors for reducing unnecessary reflection of signals. In the integrated circuit 362 according to the present embodiment, since a termination resistor for reducing unnecessary reflection of signals is provided inside the integrated circuit 362, in the liquid ejecting apparatus 1 provided with the integrated circuit 362, there is no need to provide a termination resistor. Therefore, in the drive circuit and the liquid ejecting apparatus 1 provided with the integrated circuit 362 according to the present embodiment, it is possible to further reduce the possibility that the scale of the circuit provided in the head unit 30 increases.

Further, in the integrated circuit 362 according to the present embodiment, the termination resistor is located near the restoration circuit 210 that converts the pair of differential clock signals dSCK1 and the pair of differential print data signals dSI1. Therefore, the reliability of the pair of differential clock signals dSCK1 and the pair of differential print data signals dSI1 input to the restoration circuit 210 is improved, and thus the accuracy of the clock signal SCK1 and the print data signal SI1 output from the restoration circuit 210 is improved. As a result, the ejection accuracy of the ink ejected from the ejector 600 is improved. Therefore, in the drive circuit and the liquid ejecting apparatus 1 provided with the integrated circuit 362 according to the present embodiment, it is possible not only to further reduce the possibility that the scale of the circuit provided in the head unit 30 is increased, but also to improve the ink ejection accuracy.

Further, in the integrated circuit 362 included in the liquid ejecting apparatus 1 according to the present embodiment, even if the number of the nozzles is 600 or more in the head unit 30 and the nozzles are provided at a density of 300 or more per inch, it is possible to reduce the possibility that the scale of the circuit of the liquid ejecting apparatus 1 increases.

5. Modification Example

In the present embodiment, the liquid ejecting apparatus using the piezoelectric element 60 which is a capacitive load as an example of the drive element has been described as an example, but the present disclosure drives the liquid by driving the drive element other than the capacitive load. The present disclosure is also applicable to a liquid ejecting apparatus that ejects liquid. As such a liquid ejecting apparatus, for example, there is a thermal (bubble) type liquid ejecting apparatus which ejects liquid by using bubbles generated by heating a heating element (for example, resistor) as a drive element.

Although the embodiments and the modification example have been described above, the present disclosure is not limited to these embodiments, and can be implemented in various modes without departing from the gist of the disclosure. For example, the above embodiments can be appropriately combined.

The present disclosure includes substantially the same configuration as the configuration described in the embodiment (for example, a configuration having the same function, method, and result, or a configuration having the same object and effect). In addition, the present disclosure includes a configuration in which non-essential parts of the configuration described in the embodiment are replaced. In addition, the present disclosure includes a configuration that exhibits the same operational effects as the configuration described in the embodiment or a configuration that can achieve the same object. In addition, the present disclosure includes a configuration in which a known technique is added to the configuration described in the embodiment.

What is claimed is:

1. A liquid ejecting apparatus comprising:

a drive signal output circuit that outputs a first drive signal;

a control signal output circuit that outputs an original control signal;

a differential signal output circuit that is electrically coupled to the control signal output circuit, converts the original control signal into a pair of differential signals, and outputs the pair of differential signals;

a drive signal wiring that is electrically coupled to the drive signal output circuit and through which the first drive signal propagates;

a first signal wiring that is electrically coupled to the differential signal output circuit and through which a first signal of one of the pair of differential signals propagates;

a second signal wiring that is electrically coupled to the differential signal output circuit and through which a second signal of the other of the pair of differential signals propagates; and a head unit that is electrically coupled to the drive signal wiring, the first signal wiring, and the second signal wiring, and ejects a liquid, wherein the head unit includes an integrated circuit that receives the first drive signal and outputs a second drive signal, and an ejector that is electrically coupled to the integrated circuit, includes a drive element driven based on the second drive signal, and ejects a liquid from nozzles by driving the drive element, and the integrated circuit includes a drive signal input terminal that is electrically coupled to the drive signal wiring and inputs the first drive signal, a first signal input terminal that is electrically coupled to the first signal wiring and inputs the first signal, a second signal input terminal that is electrically coupled to the second signal wiring and inputs the second signal, a differential signal receiving circuit that is electrically coupled to the first signal input terminal and the second signal input terminal, receives the first signal and the second signal, converts the pair of differential signals into a control signal, and outputs the control signal, a drive signal selection circuit that is electrically coupled to the drive signal input terminal and the differential signal receiving circuit and outputs the second drive signal based on the control signal and the first drive signal, and a drive signal output terminal that is electrically coupled to the drive signal selection circuit and outputs the second drive signal to the ejector, wherein the integrated circuit includes a first wiring that is electrically coupled to the first signal input terminal and the differential signal receiving circuit, a second wiring that is electrically coupled to the second signal input terminal and the differential signal receiving circuit, and a resistance element that is electrically coupled to the first wiring and the second wiring, and wherein the head unit includes a plurality of the integrated circuits, and a resistance value of a resistance element of a first integrated circuit of the plurality of integrated circuits is different from a resistance value of a resistance element of a second integrated circuit of the plurality of integrated circuits.

2. The liquid ejecting apparatus according to claim 1, wherein each of the integrated circuits has a first side and a second side intersecting the first side, the first side is longer than the second side, and the differential signal receiving circuit and the drive signal selection circuit is arranged side by side in a direction along the first side.

3. The liquid ejecting apparatus according to claim 1, wherein the head unit has a plurality of the ejectors, the nozzles of each of the ejectors are arranged side by side along a nozzle row direction, and the differential signal receiving circuit and the drive signal selection circuit are arranged side by side along the nozzle row direction.

4. The liquid ejecting apparatus according to claim 3, wherein the number of the nozzles of each of the ejectors in the head unit is 600 or more, and the nozzles are arranged at a density of 300 or more per inch.

5. A drive circuit comprising:

a drive signal output circuit that outputs a first drive signal;

a control signal output circuit that outputs an original control signal;

a differential signal output circuit that is electrically coupled to the control signal output circuit, converts the original control signal into a pair of differential signals, and outputs the pair of differential signals;

a drive signal wiring that is electrically coupled to the drive signal output circuit and through which the first drive signal propagates;

a first signal wiring that is electrically coupled to the differential signal output circuit and through which a first signal of one of the pair of differential signals propagates;

a second signal wiring that is electrically coupled to the differential signal output circuit and through which a second signal of the other of the pair of differential signals propagates; and an integrated circuit that is electrically coupled to the drive signal wiring, the first signal wiring, and the second signal wiring, receives the first drive signal, and outputs a second drive signal, wherein the integrated circuit includes a drive signal input terminal that is electrically coupled to the drive signal wiring and inputs the first drive signal, a first signal input terminal that is electrically coupled to the first signal wiring and inputs the first signal, a second signal input terminal that is electrically coupled to the second signal wiring and inputs the second signal, a differential signal receiving circuit that is electrically coupled to the first signal input terminal and the second signal input terminal, receives the first signal and the second signal, converts the pair of differential signals into a control signal, and outputs the control signal;

a drive signal selection circuit that is electrically coupled to the drive signal input terminal and the differential signal receiving circuit and outputs the second drive signal based on the control signal and the first drive signal, a drive signal output terminal that is electrically coupled to the drive signal selection circuit and outputs the second drive signal, wherein the integrated circuit includes a first wiring that is electrically coupled to the first signal input terminal and the differential signal receiving circuit, a second wiring that is electrically coupled to the second signal input terminal and the differential signal receiving circuit, and a resistance element that is electrically coupled to the first wiring and the second wiring, and wherein a head unit is electrically coupled to the drive signal wiring, the first signal wiring, and the second signal wiring, and ejects a liquid, wherein the head unit includes a plurality of the integrated circuits, and a resistance value of a resistance element of a first integrated circuit of the plurality of integrated circuits is different from a resistance value of a resistance element of a second integrated circuit of the plurality of integrated circuits.

6. An integrated circuit comprising:

a drive signal input terminal that inputs a first drive signal;

a first signal input terminal that inputs a first signal of one of a pair of differential signals;

a second signal input terminal that inputs a second signal of the other of the pair of differential signals;

a differential signal receiving circuit that is electrically coupled to the first signal input terminal and the second signal input terminal, receives the first signal and the second signal, converts the pair of differential signals into a control signal, and outputs the control signal;

a drive signal selection circuit that is electrically coupled to the drive signal input terminal and the differential signal receiving circuit and outputs a second drive signal based on the control signal and the first drive signal;

a drive signal output terminal that is electrically coupled to the drive signal selection circuit and outputs the second drive signal; and drive signal wiring through which the first drive signal propagates, wherein the integrated circuit includes a first wiring that is electrically coupled to the first signal input terminal and the differential signal receiving circuit, a second wiring that is electrically coupled to the second signal input terminal and the differential signal receiving circuit, and a resistance element that is electrically coupled to the first wiring and the second wiring, and wherein a head unit is electrically coupled to the drive signal wiring, the first signal wiring, and the second signal wiring, and ejects a liquid, wherein the head unit includes a plurality of the integrated circuits, and a resistance value of a resistance element of a first integrated circuit of the plurality of integrated circuits is different from a resistance value of a resistance element of a second integrated circuit of the plurality of integrated circuits.

* * * * *